US007997466B2

(12) United States Patent
Fidrych et al.

(10) Patent No.: US 7,997,466 B2
(45) Date of Patent: Aug. 16, 2011

(54) SELF STABILIZING BACKPACK

(75) Inventors: Paul J. Fidrych, Portland, OR (US); Tory M. Cross, Portland, OR (US); Christopher M. Helmsworth, Portland, OR (US)

(73) Assignee: Nike, Inc., Beaverton, OR (US)

( * ) Notice: Subject to any disclaimer, the term of this patent is extended or adjusted under 35 U.S.C. 154(b) by 746 days.

(21) Appl. No.: 11/942,186

(22) Filed: Nov. 19, 2007

(65) Prior Publication Data

US 2009/0127301 A1 May 21, 2009

(51) Int. Cl.
*A45F 3/04* (2006.01)

(52) U.S. Cl. ..... 224/634; 224/578; 224/604; 224/631; 224/641

(58) Field of Classification Search ..... 224/197, 224/263, 578, 604, 631, 634, 641, 632, 637; 24/609, 604
See application file for complete search history.

(56) References Cited

U.S. PATENT DOCUMENTS

| | | | | |
|---|---|---|---|---|
| 385,429 | A | 7/1888 | Sohner | |
| 3,707,109 | A * | 12/1972 | Bohanec | 224/257 |
| 3,885,722 | A | 5/1975 | Robertson | |
| 4,356,942 | A * | 11/1982 | Hayes | 224/630 |
| 4,660,751 | A | 4/1987 | vonDewitz | |
| 5,483,860 | A | 1/1996 | Adams | |
| 6,290,111 | B1 * | 9/2001 | Hedenberg et al. | 224/262 |
| 6,305,535 | B1 | 10/2001 | Fair | |
| 6,474,523 | B2 * | 11/2002 | Morrison et al. | 224/578 |
| 6,568,575 | B1 | 5/2003 | Bartholomew | |
| 6,607,108 | B2 | 8/2003 | Mydans | |
| 6,637,631 | B2 | 10/2003 | Lafoux et al. | |
| 6,651,853 | B2 * | 11/2003 | Higgins et al. | 224/155 |
| 6,687,963 | B1 * | 2/2004 | Chang | 24/579.11 |
| 6,871,766 | B2 | 3/2005 | Nordstrom | |
| 2006/0011689 | A1 | 1/2006 | Reid | |
| 2006/0175365 | A1 | 8/2006 | Sandler | |
| 2008/0197163 | A1 * | 8/2008 | Yip | 224/635 |

FOREIGN PATENT DOCUMENTS

| | | | |
|---|---|---|---|
| JP | 2000-004918 | | 1/2000 |
| JP | 2006068454 | A * | 3/2006 |
| WO | WO 2007003104 | A1 * | 1/2007 |

* cited by examiner

*Primary Examiner* — Justin M Larson
*Assistant Examiner* — Steven M Landolfi, Jr.
(74) *Attorney, Agent, or Firm* — Plumsea Law Group, LLC

(57) ABSTRACT

A backpack with a self stabilizing shoulder strap system is disclosed. The backpack includes two shoulder straps, an intermediate member, and a bag. The bag is configured to pivot about a first connector associated with the intermediate member. The shoulder straps are configured to pivot about connectors associated with the intermediate member. The configuration of the shoulder strap system allows for the bag to remain substantially vertical during motions as the shoulders are raised and lowered.

29 Claims, 14 Drawing Sheets

SELF STABILIZING BACKPACK

BACKGROUND OF THE INVENTION

1. Field of the Invention

The present invention relates generally to backpacks and in particular to self stabilizing backpacks.

2. Description of Related Art

Nordstrom (U.S. Pat. No. 6,871,766) discloses a pivoting shoulder strap for a backpack. The Nordstrom design includes a backpack with shoulder straps. The shoulder straps are connected to a pivoting mechanism. The upper portion of the shoulder straps are configured to rotate about these pivoting mechanisms, allowing the straps to adjust to the particular shape of a wearer's shoulders.

Although the Nordstrom design includes pivoting shoulder straps, there is no provision for further adjustment of the backpack to a wearer's back as they move and as the wearer's shoulders move up and down.

Bartholomew (U.S. Pat. No. 6,568,575) teaches a harness assembly with detachable and interchangeable pouches. The Bartholomew device includes a harness. The harness includes a left shoulder strap, a right shoulder strap, a left torso strap and a right torso strap, disposed on the rear side of a wearer. Each of these straps is connected to a central strap coupler such that each strap pivots freely with respect to central strap coupler. Using this design, the harness may freely adjust to a wearer's back and shoulders.

While the Bartholomew device incorporates pivoting straps, it does not include provisions for supporting a pack on the user's back. Furthermore, the Bartholomew device includes pivot points that are generally fixed at the central portion of a user's back. Also, because there are four straps attached at the central strap coupler, tension from each strap may limit the degree to which the straps can pivot freely.

Von Dewitz (U.S. Pat. No. 4,660,751) teaches a device to secure shoulder straps of a rucksack. The von Dewitz device includes shoulder straps, including curved slots. Each of the straps can pivot around a screw. As the straps pivot about the screw, the curved slots slide over the screw. The screws are further configured to slide on a retaining piece slot. The screws may be tightened in place on the retaining piece slot, depending on the desired fit. The screw can also be tightened so that the straps are fixed with the screw in a fixed position on the curved slots.

The von Dewitz design includes a vertical adjustment mechanism and a strap pivoting mechanism, however these adjustments are made prior to use. In particular, the design does not include provisions for adjustments that can be made during use, as the wearer turns and/or leans.

Reid (U.S. patent number 2006/0011689) teaches a backpack suspension system. In the Reid design, the backpack includes a suspension system associated with the rear wall of the backpack and connects a waist belt to a pack bag of the backpack. The suspension system further includes a mounting plate and a rocker arm. The rocker arm may rotate about a pivot axis of the mounting plate. First and second hip stays are attached to the rocker arm by way of two resilient members.

The rocker arm, in conjunction with the hip stays, provide a suspension between the pack bag and the waist belt. This allows the load of the pack bag to be dynamically transferred to the waist belt through various movements and prevents the load from being pushed into a position of instability.

The Reid design includes only a single pivot point at the mounting plate. Furthermore, the suspension system is configured to be low on a wearer's back. Therefore, the Reid design allows for adjustment of the pack at the waist area, but does not allow for dynamic adjustment at the shoulders.

There is a need in the art for a backpack that includes provisions for self stabilization, especially with respect to left/right swaying that may occur as a wearer moves.

SUMMARY OF THE INVENTION

A self stabilizing backpack is disclosed. In one aspect, the invention provides a backpack, comprising: a bag and a shoulder strap system; the shoulder strap system including an intermediate member, a first shoulder strap and a second shoulder strap; the intermediate member being attached to the bag at a first connector; the first shoulder strap being attached to the intermediate member at a second connector and the second shoulder strap being attached to the intermediate member at a third connector; the first connector being disposed below and between the second connector and the third connector of the intermediate member; and wherein the bag may pivot about the first connector, the first shoulder strap may pivot about the second connector and wherein the second shoulder strap may pivot about the third connector.

In another aspect, the bag may pivot 360 degrees about the first connector.

In another aspect, the first shoulder strap may pivot 360 degrees about the second connector.

In another aspect, the second shoulder strap may pivot 360 degrees about the third connector.

In another aspect, the intermediate member has an asymmetric shape.

In another aspect, the intermediate member is v-shaped.

In another aspect, the invention provides a backpack, comprising: a bag attached to a shoulder strap system; and where a central axis that bisects that bag and intersects the center of mass is oriented in a generally downwards direction at all times.

In another aspect, the shoulder strap system includes a first shoulder strap.

In another aspect, the shoulder strap system includes a second shoulder strap.

In another aspect, the shoulder strap system includes an intermediate member.

In another aspect, the bag is attached to the intermediate member via a first connector and the bag is configured to pivot around the first connector.

In another aspect, the first shoulder strap is attached to the intermediate member via a second connector and the first shoulder strap is configured to pivot around the second connector.

In another aspect, the second shoulder strap is attached to the intermediate member via a third connector and the second shoulder strap is configured to pivot around the third connector.

In another aspect, the invention provides a backpack, comprising: a bag and a shoulder strap system; the shoulder strap system being attached to the bag by a connector; and where the backpack can pivot about the connector through a plane parallel with a front side of the backpack.

In another aspect, the shoulder strap system includes an intermediate member.

In another aspect, the bag includes a first plate with a first positive attachment region.

In another aspect, the intermediate member includes a first negative attachment region associated with the first positive attachment region.

In another aspect, the intermediate member rotates with respect to the bag through the connection between the first positive attachment region and the first negative attachment region.

In another aspect, the first negative attachment region includes a first set of raised stops.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
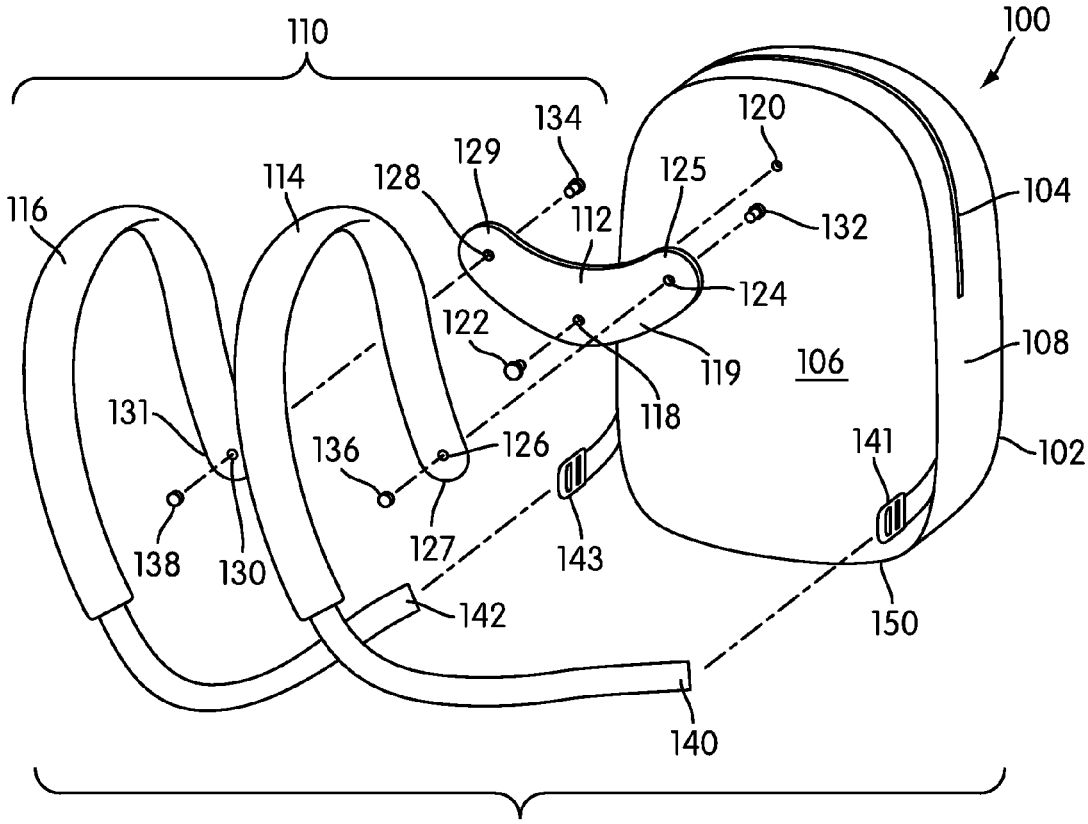
FIG. 1 is an exploded isometric view of a preferred embodiment of a backpack.

FIG. 1 is a preferred embodiment of backpack 100. The term 'backpack', as used throughout this detailed description, refers to any device used for carrying items, including, but not limited to, clothing, food, as well as other personal items, which includes shoulder straps and that is intended to be worn on a wearer's back. Generally, backpacks may include one or more large central compartments, as well as additional smaller compartments or pockets, intended for storing items.

In this preferred embodiment, backpack 100 may include bag 102. In this embodiment, bag 102 has a generally rectangular shape; however, in other embodiments bag 102 may have other shapes as well. In this embodiment, bag 102 may include primary storage compartment 108. Bag 102 may also include zipper 104, configured to open and close, allowing a wearer access to primary storage compartment 108.

For the purposes of clarity, bag 102 is shown here as a generic bag, however, in other embodiments, bag 102 may include many additional features. Examples of additional features include, but are not limited to, additional storage compartments and/or additional pockets, as well as additional straps, including, hip or waist belts.

Generally, bag 102 may be made from a variety of natural and/or synthetic materials. In some embodiments, bag 102 may be made of leather and/or cotton. In other embodiments, synthetic fabrics may be used, including vinyl, nylon, as well as various other polyamides and/or polyesters. Additionally, bag 102 may be reinforced with various waterproofing agents for protection against rain.

Preferably, backpack 100 includes provisions for securing bag 102 to a wearer's back. In some embodiments, backpack 100 may include straps of some kind. In a preferred embodiment, backpack 100 may include a shoulder strap system, including multiple shoulder straps.

In some embodiments, backpack 100 may include shoulder strap system 110. Shoulder strap system 110 may comprise intermediate member 112, as well as first shoulder strap 114 and second shoulder strap 116. In a preferred embodiment, intermediate member 112 may be v-shaped. In other embodiments, intermediate member 112 may have another shape.

Preferably, intermediate member 112 may include first intermediate hole 118 that is associated with first bag hole 120 of bag 102. In some embodiments, first intermediate hole 118 may be disposed on lower portion 119 of intermediate member 112. First bag hole 120 may be disposed on front side 106 of bag 102. Preferably, first bag hole 120 may be disposed on the upper half of front side 106, to assure that first bag hole 120 will be above the center of mass. This arrangement allows for a more stable configuration of backpack 100. In a preferred embodiment, intermediate member 112 may be attached to bag 102 via first connector 122 that is inserted through first intermediate hole 118 and first bag hole 120.

Intermediate member 112 may also include second intermediate hole 124 that is associated with first strap hole 126 of first strap 114 and third intermediate hole 128 that is associated with second strap hole 130 of second shoulder strap 116. Generally, second intermediate hole 124 and third intermediate hole 128 are disposed on first upper portion 125 and second upper portion 129 of intermediate member 112, respectively. Also, first strap hole 126 and second strap hole 130 may be disposed on first upper end 127 and second upper end 131 of first strap 114 and second shoulder strap 116, respectively. In a preferred embodiment, intermediate member 112 may be attached to first shoulder strap 114 via second connector 132. Likewise, intermediate member 112 may be attached to second shoulder strap 116 via third connector 134.

Generally, connectors 122, 132 and 134 may be any type of connector. In some embodiments, connectors 122, 132 and 134 may be pins, screws, bolts, snaps, or another type of connector. In the embodiment shown in FIG. 1, second connector 132 and third connector 134 include first receiving member 136 and second receiving member 138, respectively.

First lower end 140 of first shoulder strap 114 may be associated with first receiving slot 141 of bag 102. In a similar manner, second lower end 142 of second shoulder strap 116 may be associated with second receiving slot 143 of bag 102. With this configuration, first lower end 140 and second lower end 142 of shoulder straps 114 and 116 may be adjustably attached to bag 102 at lower portion 150.

Figure 2:
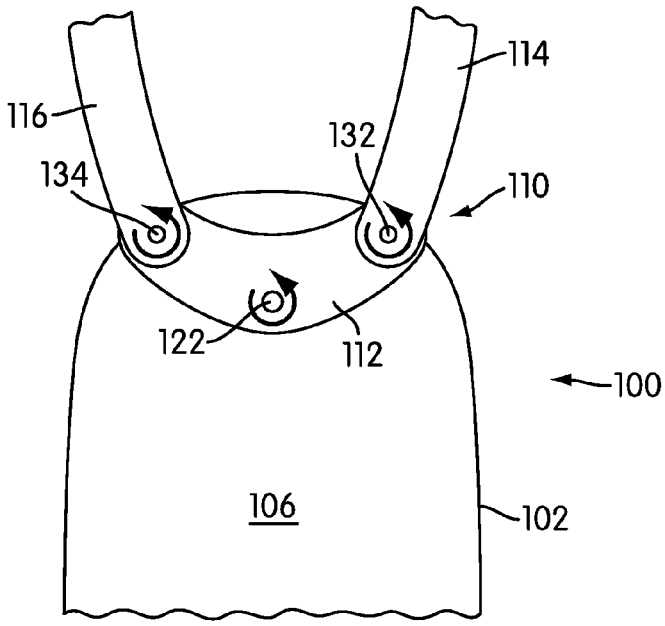
FIG. 2 is a plan view of a preferred embodiment of a backpack.

FIG. 2 is an assembled view of a preferred embodiment of backpack 100, including shoulder strap system 110. In the preferred embodiment, once assembled, intermediate member 112 is preferably disposed against front side 106 of bag 102. Additionally, first shoulder strap 114 and second shoulder strap 116 are preferably disposed against intermediate member 112. Using this preferred embodiment, connectors 122, 132 and 134 preferably act as pivots about which intermediate member 112, first shoulder strap 114 and second shoulder strap 116 can move, respectively. In other words, connectors 122, 132 and 134 are fastened in a manner that prevents intermediate member 112, first shoulder strap 114 and second shoulder strap 116 from moving in a direction perpendicular to front side 106, but which allows intermediate member 112, first shoulder strap 114 and second shoulder strap 116 to rotate about connectors 122, 132 and 134.

As indicated in FIG. 2, the preferred embodiment of first intermediate member 112 may generally rotate 360 degrees about first connector 122. Likewise, first shoulder strap 114 may generally rotate 360 degrees about second connector 132 and second shoulder strap 116 may generally rotate 360 degrees about third connector 134. In other embodiments, the range of motion of intermediate member 112, first shoulder strap 114 and/or second shoulder strap 116 may be limited to less than 360 degrees. Furthermore, although the physical connections between first shoulder strap 114, second shoulder strap 116 and intermediate member 112 via connectors 132 and 134 are configured to allow for 360 degree rotation, in some cases the degree of rotation may be limited by the connections between lower strap ends 140 and 142 to bag 102 or by other similar restraints on shoulder strap system 110, as shown in FIG. 1.

It should also be understood that in the preferred embodiment, shoulder straps 114 and 116 pivot freely with respect to intermediate member 112 at all times. Likewise, intermediate member 112 may pivot freely with respect to bag 102 at all times. In other words, pivoting about connectors 122, 132 and 134 may occur at anytime and is not dependent on the loosening or fastening of various mechanisms (such as screws) for allowing or preventing pivoting. In alternative embodiments, shoulder strap system 110 could include provisions for controlling when, or the degree to which, the system may pivot.

Generally, connectors 122, 132 and 134, and thus the regions of relative pivoting, may be disposed at different portions of intermediate member 112. In another embodiment, intermediate member 112 may have a different shape than the v-like shape shown in the figures and connectors 132 and 134 may be disposed further away or closer to one another (in the horizontal direction), for example. Likewise, in some embodiments, the position of first connector 122 relative to connectors 132 and 134 may be modified. Preferably, however, in each embodiment, first connector 122 is disposed between connectors 132 and 134 in the horizontal direction and below connectors 132 and 134 in the vertical direction. This preferred arrangement of connectors 122, 132 and 134 provides for a stable configuration of bag 102 with respect to shoulder strap system 110. If, for example, first connector 122 were disposed above connectors 132 and 134, this configuration would be less stable as the weight of bag 102 at first connector 122 may cause intermediate member 112 to tip or tilt to the right or left. Likewise, if first connector 122 were disposed to the left or right of both connectors 132 and 134, intermediate member 112 may tip or tilt in a similar manner.

Although the preferred embodiment includes three pivots, other systems can include more or less than three pivots. For example, in another embodiment, shoulder straps 114 and 116 may be connected to intermediate member 112 via connectors 132 and 134, allowing for pivoting at these regions, but intermediate member 112 may be fastened directly to bag 102, without the use of a pivoting connector. Also, in some embodiments, shoulder straps 114 and 116 may be fastened in place to intermediate member 112, without the use of pivoting connectors, while intermediate member 112 may be connected to bag 102 via first connector 122. In some cases, modifying the number of pivots may limit some of the functions of backpack 100 that are described throughout the remainder of this detailed description.

Figure 3:
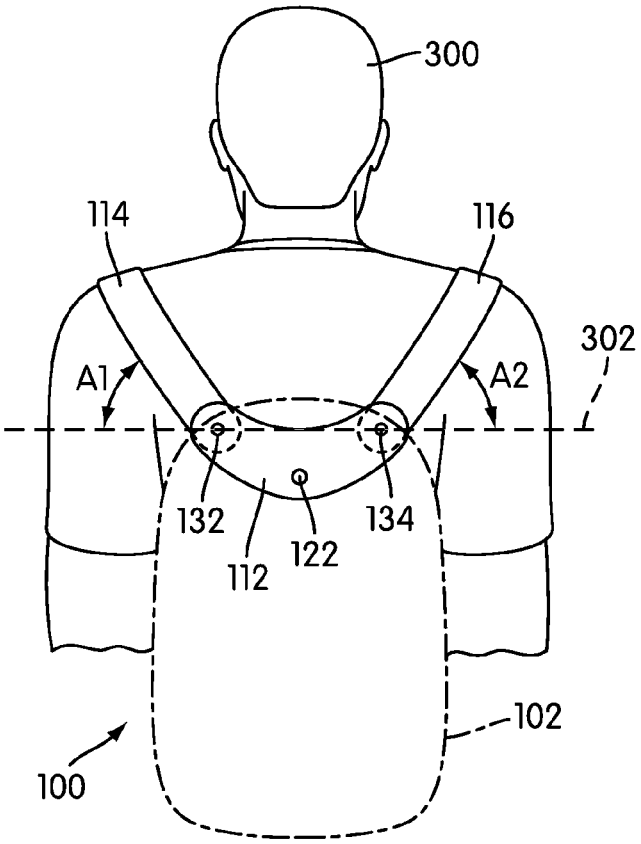
FIG. 3 is a preferred embodiment of a backpack on a wearer's back.
Figure 4:
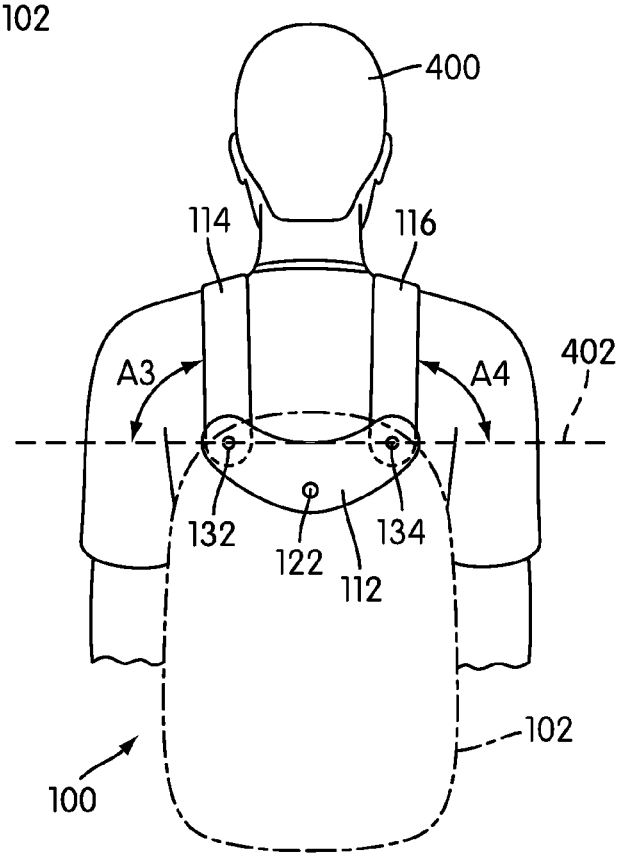
FIG. 4 is a cross sectional view of a preferred embodiment of a backpack on a wearer's back.

Referring to FIGS. 3 and 4, the preferred embodiment of backpack 100 includes provisions for accommodating wearers with various shoulder widths. Preferably, first wearer 300 includes wide shoulders. Preferably, first shoulder strap 114 and second shoulder strap 116 pivot with respect to intermediate member 112, at second connector 132 and third connector 134, respectively. As shoulder straps 114 and 116 pivot, intermediate member 112 preferably maintains a constant orientation with respect to bag 102 (shown in phantom).

In this embodiment, first shoulder strap 114 and second shoulder strap 116 have pivoted at a first angle A1 and a second angle A2 from horizontal axis 302 that extends through connectors 132 and 134. Generally, angles A1 and A2 may have similar values. In this preferred embodiment, angles A1 and A2 are both approximately 45 degrees.

In another embodiment, backpack 100 may be worn by second wearer 400. Preferably, second wearer 400 includes shoulders that are narrower than the shoulders of first wearer 300. As with the previous embodiment, first shoulder strap 114 and second shoulder strap 116 of backpack 100 may pivot at second connector 132 and third connector 134, respectively. In this embodiment, first shoulder strap 114 and second shoulder strap 116 have pivoted at a third angle A3 and a fourth angle A4 from horizontal axis 402 that extends through connectors 132 and 134. Generally, angles A3 and A4 may have similar values. In this preferred embodiment, angles A3 and A4 are both approximately 90 degrees.

As previously discussed, shoulder straps 114 and 116 preferably pivot freely about connectors 132 and 134. Therefore, there is no need for the wearer to manually adjust shoulder straps 114 and 116 during use. Instead, shoulder straps 114 and 116 will simply maintain a particular orientation with respect to intermediate member 112 depending on the width of the wearer's shoulders. With this configuration, backpack 100 may be easily adjusted to fit different wearers with possibly different shoulder widths.

Preferably, backpack 100 includes provisions for self-stabilization. In some embodiments, backpack 100 may include provisions that help keep bag 102 in a generally vertical position, thus reducing the tendency of the center of mass of bag 102 to shift in the horizontal direction. Furthermore, backpack 100 may include provisions that allow shoulder straps 114 and 116 to automatically adjust to the movement of a wearer's shoulders, increasing the stability of backpack 100.

Figure 5:
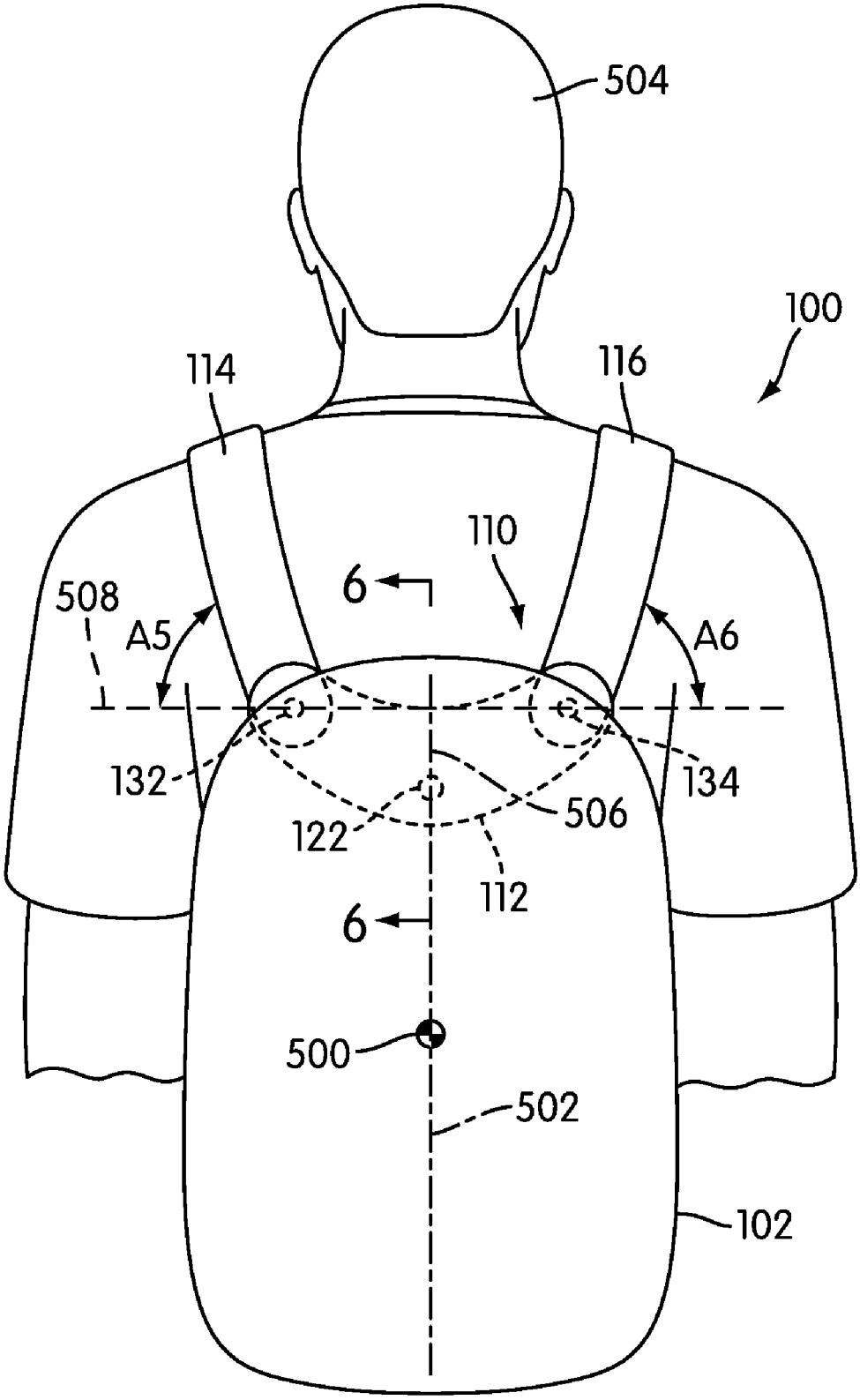
FIG. 5 is a preferred embodiment of a backpack on a wearer's back.
Figure 6:
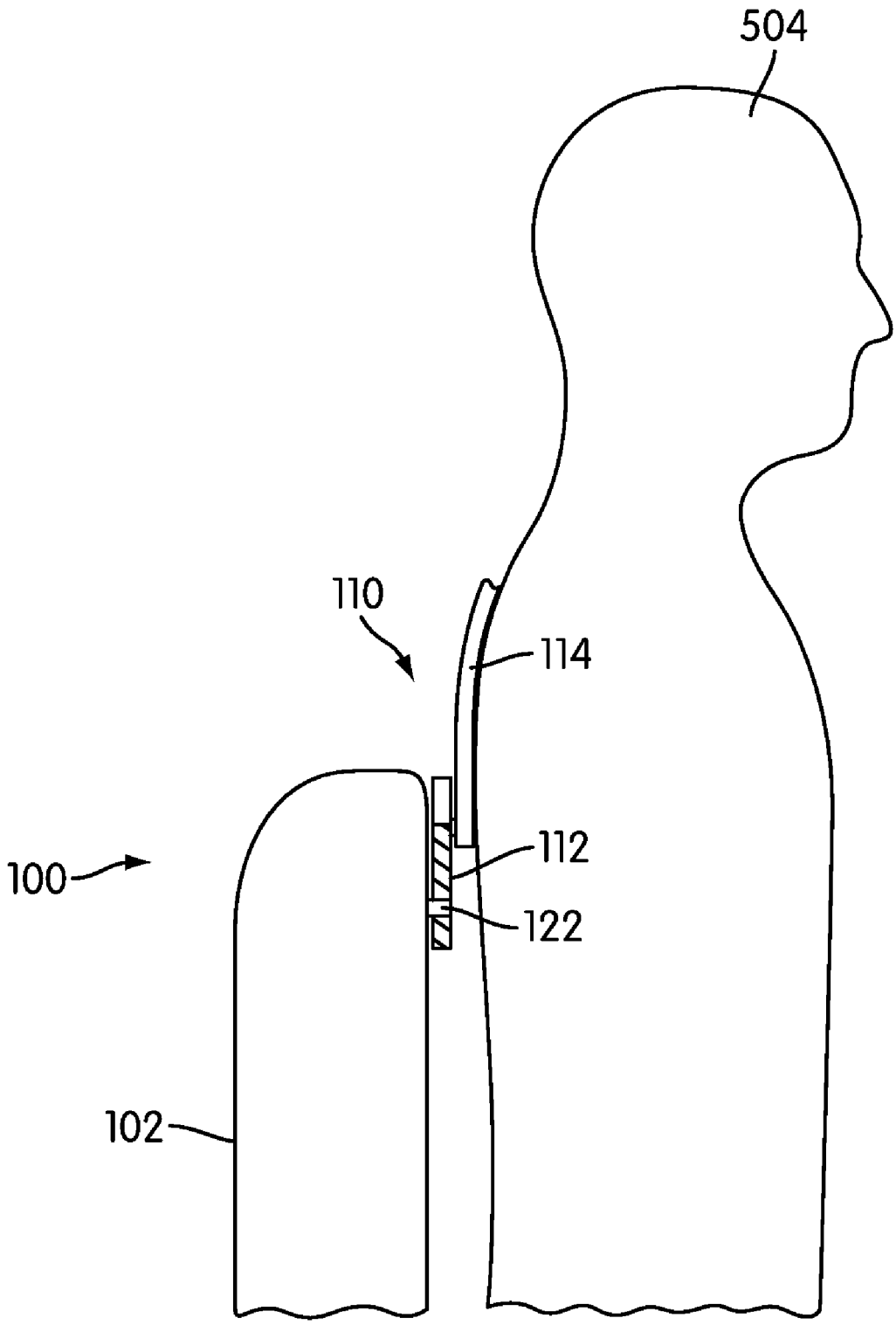
FIG. 6 is a side view of a preferred embodiment of a backpack.

Referring to FIGS. 5 and 6, the preferred embodiment of bag 102 of backpack 100 is configured to hang from first connector 122. Bag 102 includes center of mass 500. In this embodiment, central axis 502 bisects bag 102 and intersects center of mass 500. Preferably, central axis 502 is directed downwards. The term 'downwards', as used here and throughout this detailed specification, and in the claims, refers to the direction towards the earth's center of gravity. In some cases, this direction may be perpendicular to the ground, wherever the ground is generally flat. In this configuration, bag 102 can be said to be approximately vertical.

It is clear from FIG. 6 that the preferred embodiment of bag 102 is only connected to shoulder strap system 110 at first connector 122. Traditional backpack designs use at least two points of contact at the upper portion of the bag, including the connections between a first shoulder strap and a second shoulder strap directly to the bag. This single connection arrangement between bag 102 and intermediate member 112 allows bag 102 to pivot freely with respect to strap system 110. In particular, increasing the number of connections between bag 102 and shoulder strap system 110 would prohibit this pivoting motion of bag 102.

FIG. 5 represents the preferred embodiment of the configuration of backpack 100, and in particular shoulder strap system 110, when wearer 504 is in a generally vertical and/or stationary position. In this configuration, central axis 502 is preferably coincident with symmetric axis 506, which is the axis of symmetry of intermediate member 112. In particular, symmetric axis 506 intersects first connector 122. Furthermore, first shoulder strap 114 is disposed at a fifth angle A5 from first axis 508 that intersects connectors 132 and 134. Also, second shoulder strap 116 is disposed at a sixth angle A6 from first axis 508. In some embodiments, angles A5 and A6 may be equal. Generally, angles A5 and A6 will be determined by the width of the shoulders of wearer 504, as discussed with respect to the previous embodiments.

Figure 7:
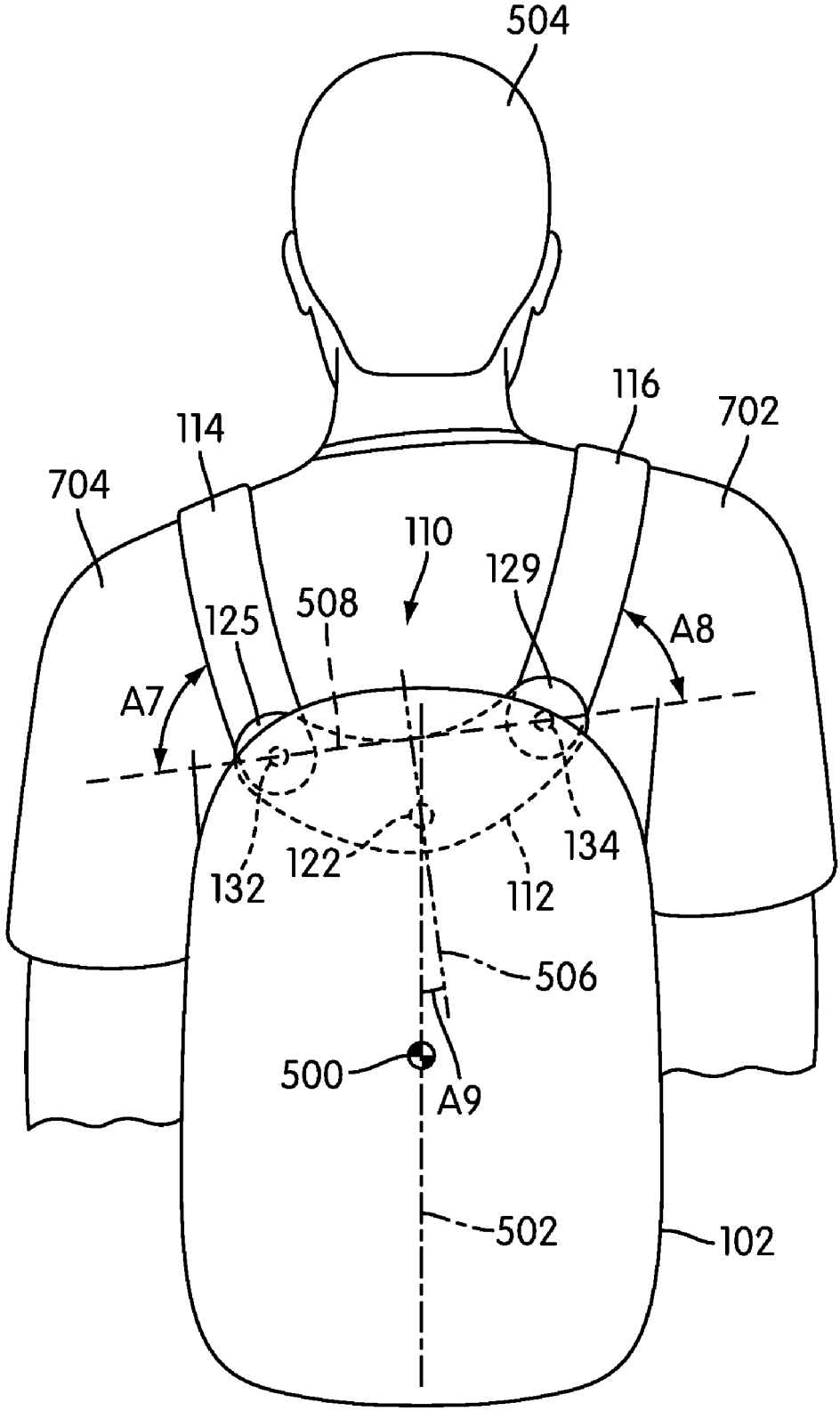
FIG. 7 is a preferred embodiment of a backpack on a wearer's back with the wearer's right shoulder lifted.

Typically, as a wearer walks, runs, or moves in general, their shoulders will raise and lower. FIG. 7 is an embodiment of wearer 504, as right shoulder 702 is raised during some kind of motion. In this embodiment, as right shoulder 702 is raised, second shoulder strap 116 is also raised. As second shoulder strap 116 is raised, some tension is applied to shoulder strap system 110, and in particular to intermediate member 112. In this case, second upper portion 129 of intermediate member 112 is pulled upwards. This configuration tilts intermediate member 112 slightly, so that first axis 508 that was originally in a generally horizontal orientation, is now slightly tilted. As intermediate member 112 pivots about first connector 122, first upper portion 125 of intermediate member 112 will be lowered slightly.

At this point, first shoulder strap 114 and second shoulder strap 116 are disposed at seventh angle A7 and eighth angle A8 with respect to first axis 508. Generally, seventh angle A7 will be larger than fifth angle A5 and eighth angle A8 will be smaller than sixth angle A6, the original orientations of shoulder straps 114 and 116 with respect to intermediate member 112 in the initial configuration of the previous embodiment. (see FIG. 5) However, it should be understood that as shoulder straps 114 and 116 pivot with respect to intermediate member 112, they maintain a generally fixed orientation with respect to right shoulder 702 and left shoulder 704. With this preferred arrangement, shoulder straps 114 and 116 will not shift or slide around shoulders 702 and 704, causing discomfort via friction during walking, running, or other activities.

Preferably, as intermediate member 112 pivots with respect to first connector 122, bag 102 remains in a generally vertical position. In this embodiment, central axis 502 of bag 102 is disposed at a ninth angle A9 with respect to symmetric axis 506 of intermediate member 112. In a preferred embodiment, central axis 502 remains pointing downwards during this configuration of shoulder strap system 110.

Figure 8:
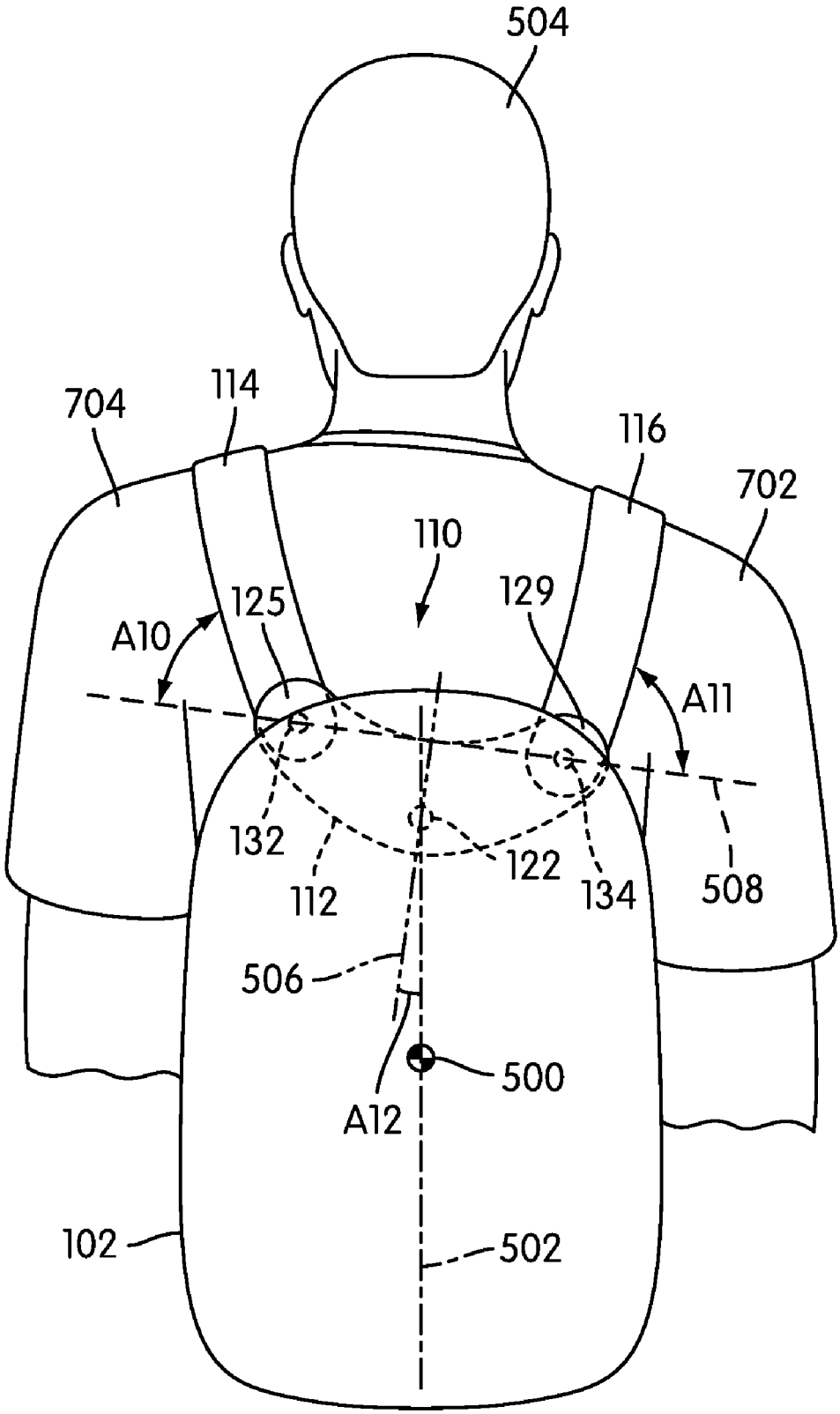
FIG. 8 is a preferred embodiment of a backpack on a wearer's back with the wearer's left shoulder lifted.

Referring to FIG. 8, as wearer 504 raises left shoulder 704 during walking, running or another activity, backpack 100 may be configured similarly to the configuration of the previous embodiment. Preferably, the configuration will be substantially similar to a mirror image of the previous configuration where right shoulder 702 is raised.

In this embodiment, as left shoulder 704 is raised, first shoulder strap 114 is also raised. As first shoulder strap 114 is raised, some tension is applied to shoulder strap system 110, and in particular to intermediate member 112. In this case, first upper portion 125 of intermediate member 112 is pulled upwards. This configuration tilts intermediate member 112 slightly, so that first axis 508 is now slightly tilted again. As intermediate member 112 pivots about first connector 122, second upper portion 129 of intermediate member 112 will be lowered slightly.

At this point, first shoulder strap 114 and second shoulder strap 116 are disposed at tenth angle A10 and eleventh angle A11 with respect to first axis 508. Generally, tenth angle A10 will be smaller than fifth angle A5 and eleventh angle A11 will be larger than sixth angle A6, the original orientations of shoulder straps 114 and 116 with respect to intermediate member 112 in the initial configuration of the previous embodiment (as shown in FIG. 5.) However, it should be understood that as shoulder straps 114 and 116 pivot with respect to intermediate member 112, they maintain a generally fixed orientation with respect to right shoulder 702 and left shoulder 704. With this preferred arrangement, shoulder straps 114 and 116 will not shift or slide around shoulders 702 and 704, causing discomfort during walking, running, or other activities.

Preferably, as intermediate member 112 pivots with respect to first connector 122, bag 102 remains in a generally vertical position. In this embodiment, central axis 502 of bag 102 is disposed at a twelfth angle A12 with respect to symmetric axis 506 of intermediate member 112. In a preferred embodiment, central axis 502 remains pointing downwards during this configuration of shoulder strap system 110.

With this preferred arrangement, as shoulders 702 and 704 are raised and lowered during motion, bag 102 remains generally vertical. This configuration is preferable, since it limits the degree that center of mass 500 is swayed or tilted to the left and right during motion. In addition, using this preferred configuration, center of mass 500 will generally remain at the lowest possible position during motion, which is a preferred feature for maintaining stability. This in contrast to traditional backpack designs that do not allow for the center of mass to move independently of the shoulder strap system.

Figure 9:
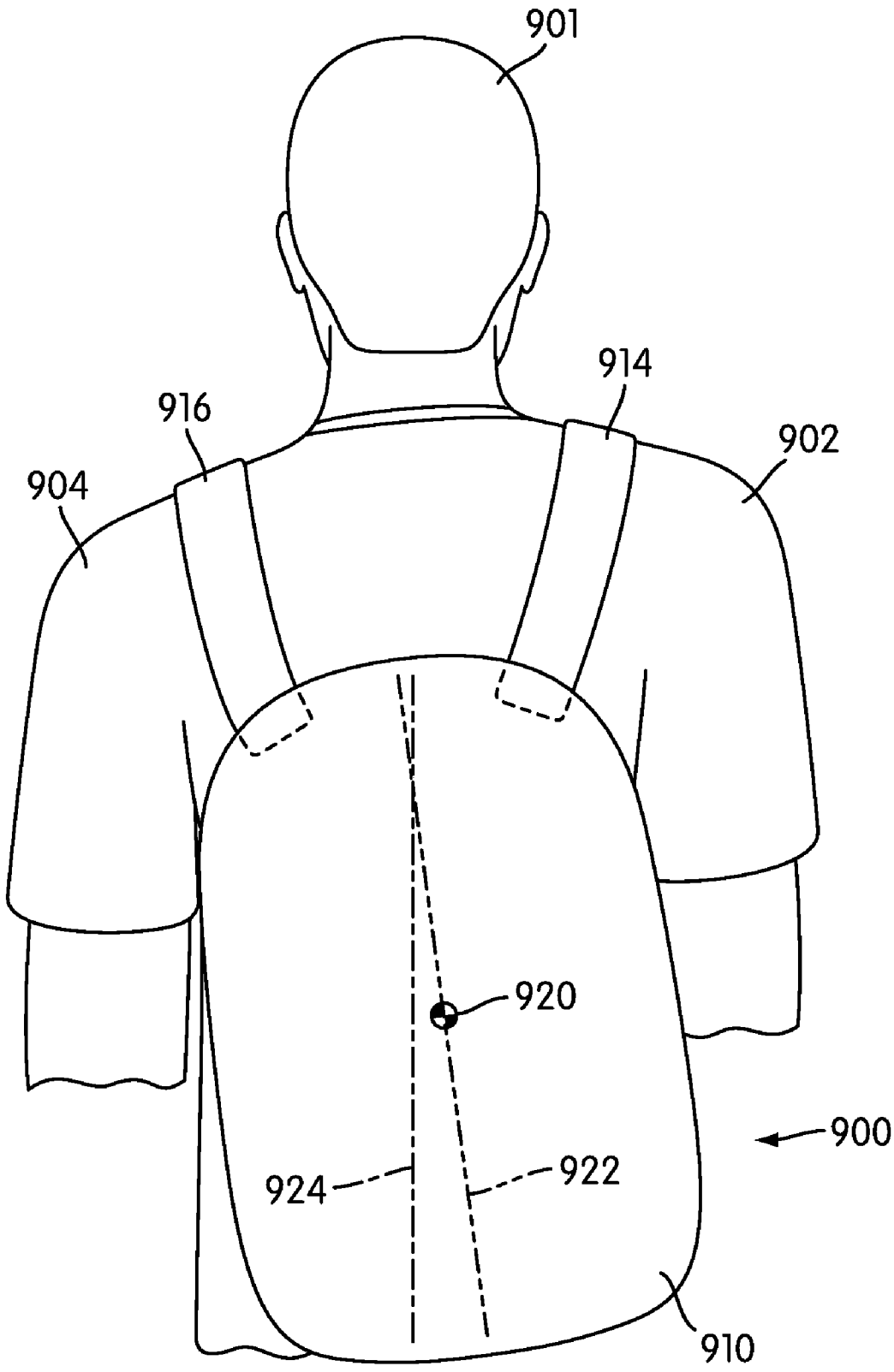
FIG. 9 is an embodiment of a traditional backpack on a wearer's back with the wearer's right shoulder lifted.

FIG. 9 is an embodiment of backpack 900, representing prior art backpack designs. Backpack 900 includes bag 910, as well as first shoulder strap 914 and second shoulder strap 916. In this embodiment, right shoulder 902 of wearer 901 has been raised during a typical walking or running motion. As shoulder 902 is raised, first shoulder strap 914 is also raised. Because traditional backpack designs do not allow for bag 910 to move independently (or pivot) with respect to shoulder straps 914 and 916, bag 910 is tilted under the tension of first shoulder strap 914.

In this configuration of backpack 900, central axis 922 of bag 910 has tilted slightly. This is clear by comparing the orientation of central axis 922 with initial axis 924 that represents the orientation of central axis 922 before shoulder 902 is raised. In particular, center of mass 920, disposed on central axis 922, has shifted slightly to the right.

As wearer 901 moves continues moving, left shoulder 904 will eventually rise as well, resulting in a configuration where center of mass 920 has shifted slightly to the left. This will continue throughout walking, running, or other types of motion, resulting in a swinging of the center of mass back and forth from left to right. These oscillations of the center of mass will decrease the stability of backpack 900 against wearer 901, and in some cases, may decrease the ability of wearer 901 to balance.

Preferably, a backpack may include provisions for limiting motion of one or more straps or an intermediate member. FIGS. 10-21 illustrate a second embodiment of a self stabilizing backpack. Backpack 1000 preferably includes several provisions for limiting motion. This preferred arrangement may prevent excessive swinging of a bag associated with backpack 1000, as excessive swinging may cause discomfort to a user or may increase instability.

Figure 10:
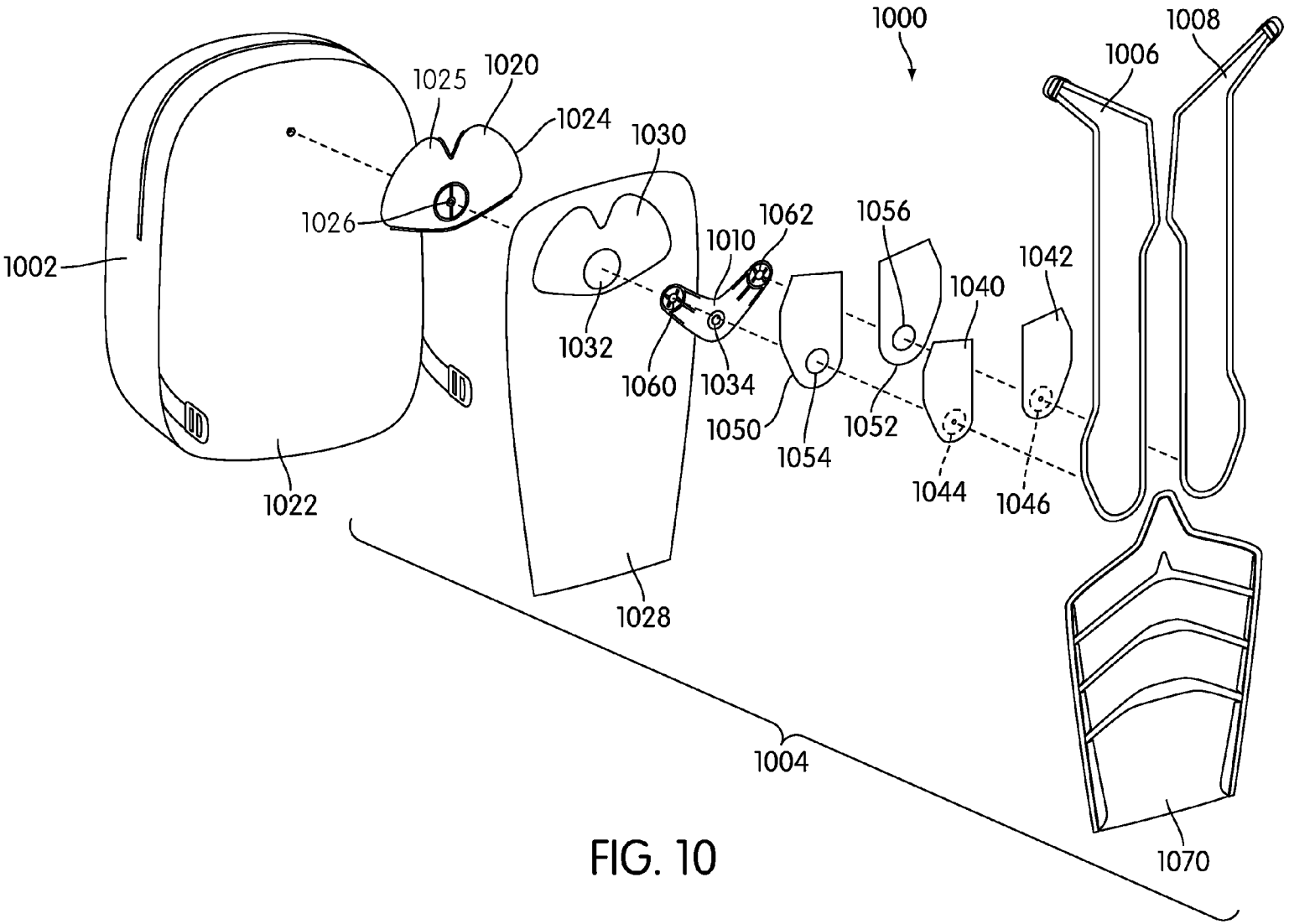
FIG. 10 is an exploded isometric view of a preferred embodiment of a backpack.

FIG. 10 is an exploded isometric view of a preferred embodiment of backpack 1000. Preferably, backpack 1000 includes bag 1002. Generally, bag 1002 may include similar provisions to bag 102 of the previous embodiments (see FIG. 1.) In this preferred embodiment, bag 1002 has a generally rectangular shape, however in other embodiments the shape of bag 1002 may be modified.

Backpack 1000 also includes shoulder strap system 1004. Shoulder strap system 1004 preferably includes first shoulder strap 1006, second shoulder strap 1008 and intermediate member 1010. Preferably, shoulder strap system 1004 comprises additional components configured to facilitate the connection of first shoulder strap 1006, second shoulder strap 1008 and intermediate member 1010 with bag 1002. In particular, shoulder strap system 1004 preferably includes motion limiting components.

In some embodiments, an intermediate member may be connected directly to a bag, as was discussed in the previous embodiment. In other embodiments, a plate may be used to facilitate the connection of the intermediate member to the bag. In a preferred embodiment, the plate may include provisions that allow the intermediate member to rotate.

In this preferred embodiment, shoulder strap system 1004 includes first large plate 1020. First large plate 1020 preferably includes first rounded side 1024 and second rounded side 1025. Preferably, first large plate 1020 also includes first positive attachment region 1026.

Generally, first large plate 1020 may be made of any material. Preferably, first large plate 1020 may be made of a rigid material that is configured to support shoulder strap system 1004. Examples of materials include, but are not limited to, plastics, metals, carbon fibers as well as other materials. In a preferred embodiment, first large plate 1020 may be made of plastic.

First large plate 1020 is preferably configured to attach to rear side 1022 of bag 1002. In some embodiments, first large plate 1020 may be placed inside a sleeve or similar provision associated with bag 1002. In a preferred embodiment, the attachment of first large plate 1020 to bag 1002 is facilitated using first cover 1028. In this embodiment, first cover 1028 may be attached directly to rear side 1022 of bag 1002. Preferably, first cover 1028 is made of a similar material to bag 1002 and sewn directly to rear side 1022 of bag 1002. Simultaneously, first sleeve 1030 of first cover 1028 may be sewn to rear side 1022, enclosing first large plate 1020 between first cover 1028 and bag 1002 within first sleeve 1030.

Preferably, first sleeve 1030 includes first hole 1032 that allows first attachment region 1026 of first large plate 1020 to be exposed through first cover 1028. This preferred arrangement facilitates comfort for the user, as first large plate 1020, which is generally rigid, is disposed behind first cover 1028. In some embodiments, first cover 1028 could be padded to increase comfort for the user.

It should be understood that in other embodiments, first large plate 1020 may be attached directly to rear side 1022 of bag 1002 without the use of first cover 1028 and first sleeve 1030. In some embodiments, first large plate 1020 may be attached directly to rear side 1022 of bag 1002 using an adhesive of some kind. Generally, first large plate 1020 may be attached to bag 1002 using any known method of attaching a rigid material to a woven material.

Preferably, intermediate member 1010 may be configured to connect to first large plate 1020. In particular, first negative attachment region 1034 of intermediate member 1010 may be configured to connect to first positive attachment region 1026 of first large plate 1020. Preferably, this connection is made through first hole 1032 of first cover 1028. Intermediate member 1010 is preferably connected in a manner that allows for some rotation of intermediate member 1010 with respect to first large plate 1020. Because first large plate 1020 is fixed into place with respect to bag 1002 via first sleeve 1030 of first cover 1028, intermediate member 1010 may rotate with respect to bag 1002 using this arrangement.

In some embodiments, a shoulder strap system may also include provisions for attaching an intermediate member to the shoulder straps. In some cases, the intermediate member may be connected directly to the shoulder straps as was discussed in the previous embodiment. In other cases, the intermediate member may be connected to plates that are further associated with the shoulder straps. In a preferred embodiment, the intermediate member is configured to attach to the shoulder straps via plates that are configured to rotate with respect to the intermediate member.

In this embodiment, shoulder strap system 1004 also includes second plate 1040 and third plate 1042. Plates 1040 and 1042 preferably include second positive attachment region 1044 and third positive attachment region 1046. For purposes of illustration, attachment regions 1044 and 1046 are shown here in phantom. Further discussion of attachment regions 1044 and 1046 is given later in this detailed description.

Plates 1040 and 1042 may be made of a similar material to first large plate 1020, such as plastic, metal, carbon fibers or any other type of materials. Generally, the shape of plates 1040 and 1042 are configured to conform to the shape of straps 1006 and 1008. In other embodiments, however, plates 1040 and 1042 may have any other kind of shape, including rectangles, squares, triangular, circular, as well as other types of polygons.

In this embodiment, plates 1040 and 1042 are configured to attach to first shoulder strap 1006 and second shoulder strap 1008 via second cover 1050 and third cover 1052, respectively. This may be achieved by sewing or otherwise attaching covers 1050 and 1052 directly to straps 1006 and 1008. This arrangement creates sleeves similar to first sleeve 1030 associated with first cover 1028. Using this sleeved arrangement, plates 1040 and 1042 may be enclosed between covers 1050 and 1052 and straps 1006 and 1008, thereby fixing plates 1040 and 1042 into place.

Preferably, second cover 1050 and third cover 1052 may include second hole 1054 and third hole 1056, respectively. Holes 1054 and 1056 allow attachment regions 1044 and 1046 to be exposed. In a preferred embodiment, second positive attachment region 1044 and third positive attachment region 1046 are further associated with second negative attachment region 1060 and third negative attachment region 1062 of intermediate member 1010, respectively. These connections are preferably made in a manner that allows some rotation of second plate 1040 and third plate 1042 with respect to intermediate member 1010. With this preferred arrangement, first shoulder strap 1006 and second shoulder strap 1008 may be configured to rotate with respect to intermediate member 1010.

In some embodiments, backpack 1000 may also include fourth cover 1070. Fourth cover 1070 may be configured to cover a portion of first cover 1028. Preferably, fourth cover 1070 may include additional padding that facilitates the comfort of a user when wearing backpack 1000. Additionally, fourth cover 1070 may have an aesthetically appealing design.

Figure 11:
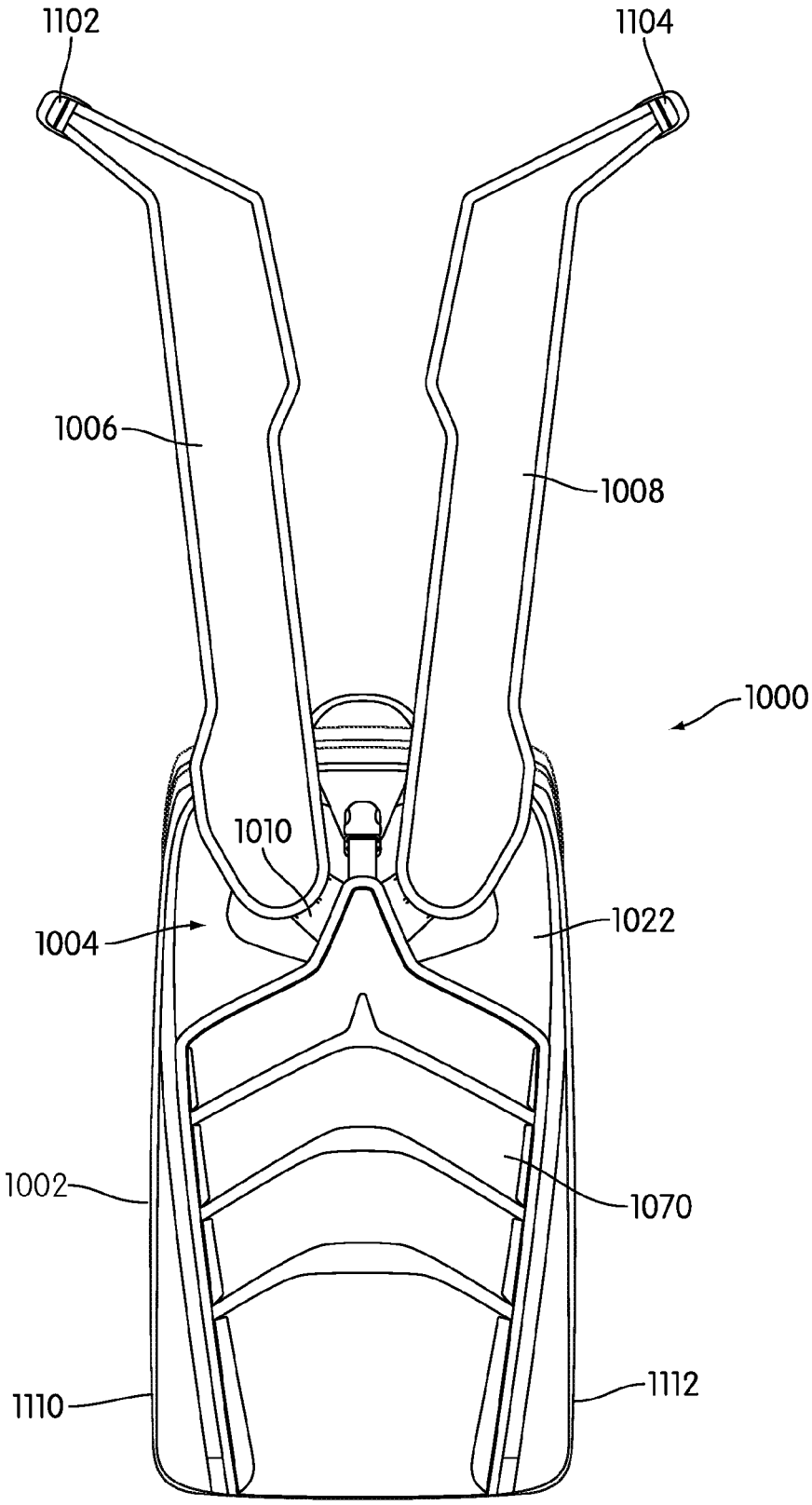
FIG. 11 is an assembled view of a preferred embodiment of a backpack.

FIG. 11 is an assembled view of a preferred embodiment of rear side 1022 of backpack 1000. In this embodiment, first shoulder strap 1006 and second shoulder strap 1008 have been raised to expose various components associated with shoulder strap system 1004. For example, intermediate member 1010 is partially exposed beneath straps 1006, 1008 and fourth cover 1070. For purposes of clarity, in this Figure and throughout the remainder of this detailed description, straps 1006 and 1008 are not attached to bag 1002 at first strap end 1102 and second strap end 1104, respectively. However, it should be understood that before backpack 1000 is worn, first shoulder strap 1006 and second shoulder strap 1008 should be attached to bag 1002 at attachment portions disposed on first side 1110 and second side 1112, respectively. Strap ends 1102 and 1104 may include any types of fasteners that are used with backpacks and known in the art.

As previously discussed, backpack 1000 preferably includes provisions for limiting the motion of one or more components that are configured to rotate. In some embodiments, attachment regions may include raised stops configured to limit rotation and prevent 360 degree rotation in particular. In this preferred embodiment, the attachment regions include positive/negative attachment regions with range limiting raised stops.

Figure 12:
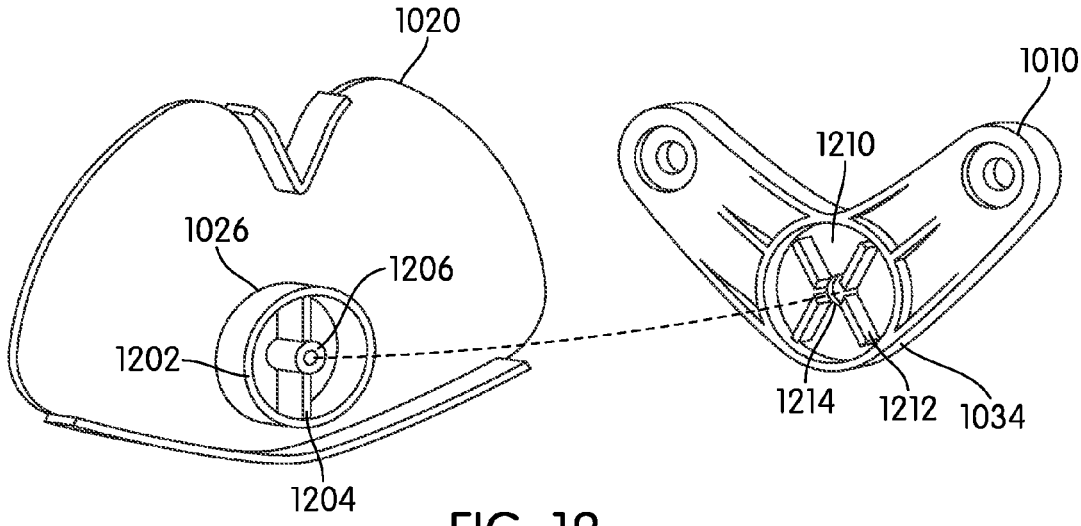
FIG. 12 is an isometric view of a preferred embodiment of intermediate member and a first plate.

FIG. 12 is a close up of a preferred embodiment of first large plate 1020 and intermediate member 1010 as they are configured to fasten to one another. As previously discussed, first large plate 1020 includes first positive attachment region 1026. First positive attachment region 1026 may include first rim 1202 and first raised portion 1204. In this embodiment, first raised portion 1204 is a thin raised rectangle that bisects first positive attachment region 1026. First positive attachment region 1026 may also include first fastener hole 1206 that is disposed on first raised portion 1204.

Preferably, intermediate member 1010 includes first negative attachment region 1034. First negative attachment region 1034 preferably includes first recessed region 1210 and first set of raised stops 1212. In this embodiment, first set of raised stops 1212 form an X-like shape. Furthermore, first negative attachment region 1034 may also include second fastener hole 1214 that is configured to receive a fastener of some kind.

In this preferred embodiment, first recessed region 1210 is configured to receive first rim 1202, thereby mating first positive attachment region 1026 and first negative attachment region 1034. As regions 1026 and 1034 are joined, first raised portion 1204 is preferably inserted between first set of raised stops 1212. Finally, a fastener (not shown) may be inserted through first fastener hole 1206 and second fastener hole 1214 in order to permanently connect first large plate 1020 and intermediate member 1010.

For purposes of clarity, first cover 1028 (see FIG. 10) is not shown in FIG. 12. However, it should be understood that in some embodiments, first cover 1028 would be disposed between first large plate 1020 and intermediate member 1010. Because first cover 1028 includes first hole 1032, first cover 1028 would not interfere with the connection of first positive attachment region 1026 and first negative attachment region 1034. Throughout the remaining embodiments, it should be understood that fastening regions may be optionally associated with covers.

Figure 13:
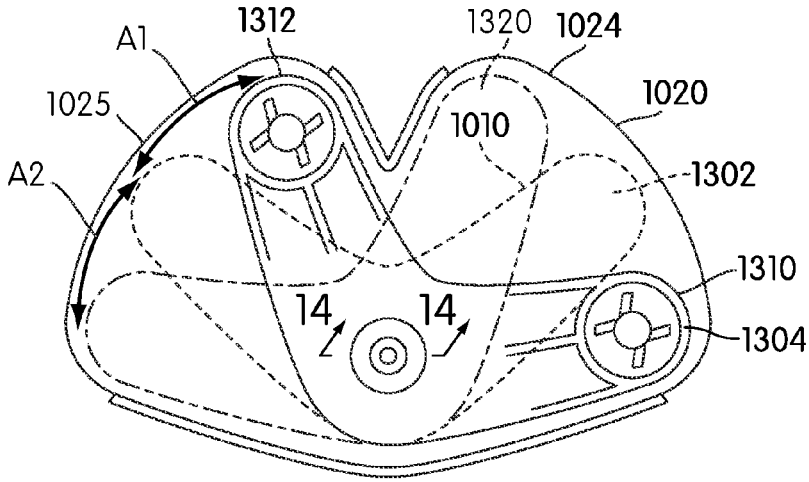
FIG. 13 is a plan view of a preferred embodiment of an intermediate member rotating.
Figure 14:
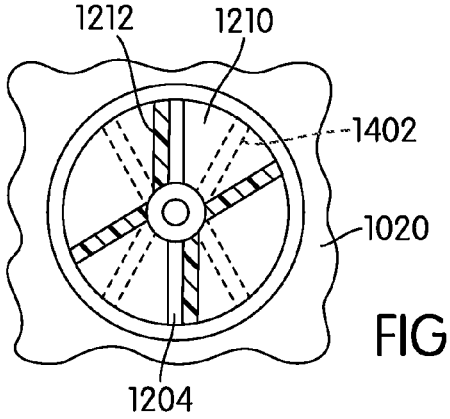
FIG. 14 is a cross sectional view of a preferred embodiment of an attachment region.

FIGS. 13 and 14 illustrate a preferred embodiment of the rotation of intermediate member 1010 with respect to first large plate 1020. In this embodiment, intermediate member 1010 begins at initial position 1302 and rotates clockwise to second position 1304. Because of the shape of first rounded side 1024 and second rounded side 1025, as intermediate member 1010 rotates, first end 1310 and second end 1312 of intermediate member 1010 are confined to first large plate 1020. In other words, this preferred shape for first large plate 1020 facilitates support for intermediate member 1010 during rotation.

Preferably, intermediate member 1010 is prevented from rotating beyond second position 1304 in the clockwise direction because of the arrangement of first positive attachment region 1026 and first negative attachment region 1034 (see FIG. 12). Referring to FIGS. 13-14, when intermediate member 1010 is in initial position 1302, first set of raised stops 1212 are initially oriented in first position 1402. At this point, intermediate member 1010 is free to rotate with respect to first large plate 1020 because the rotation of first set of raised stops 1212 within first recessed region 1210 is not impeded. However, as intermediate member 1010 reaches second position 1304, the motion of first set of raised stops 1212 is impeded by first raised portion 1204. In some embodiments, because of the symmetric arrangement of first set of raised stops 1212, intermediate member 1010 may also be prevented from moving past a third position 1320, as intermediate member 1010 is rotated in the counterclockwise direction. With this preferred arrangement, the rotation of intermediate member 1010 with respect to first large plate 1020 is limited.

Generally, the amount of rotation of intermediate member 1010 in the clockwise direction or the counterclockwise direction may vary according to the arrangement of raised stops 1212. In this embodiment, intermediate member 1010 may be configured to rotate through an angle A1 in the clockwise direction between first position 1302 and second position 1304. Likewise, in this embodiment, intermediate member 1010 may be configured to rotate through an angle A2 in the counterclockwise direction between first position 1302 and third position 1320. In some cases, angles A1 and A2 may have a similar value. In other cases, angles A1 and A2 could be different. In a preferred embodiment, angles A1 and A2 are substantially equal and have a value of approximately 29 degrees. In other words, the range of motion of intermediate member from second position 1304 to third position 1320 is approximately 58 degrees.

It should be understood that the range of motion of the current embodiment is only intended to be exemplary. In other embodiments, the range of motion could be changed by modifying the positions of the raised stops. For example, using an arrangement where the raised stops are oriented in a taller and thinner X-shape, the range of motion would be less than the range of motion of the current embodiment. Likewise, using an arrangement where the raised stops are oriented in a shorter and wider X-shape, the range of motion would be greater than the range of motion of the current embodiment. In still other embodiments, the raised stops could be oriented in other shapes besides X-like shapes to facilitate the restriction of rotations. For example, asymmetric configurations of raised stops would allow for varying degrees of maximum rotation between clockwise and counterclockwise rotations.

Figure 15:
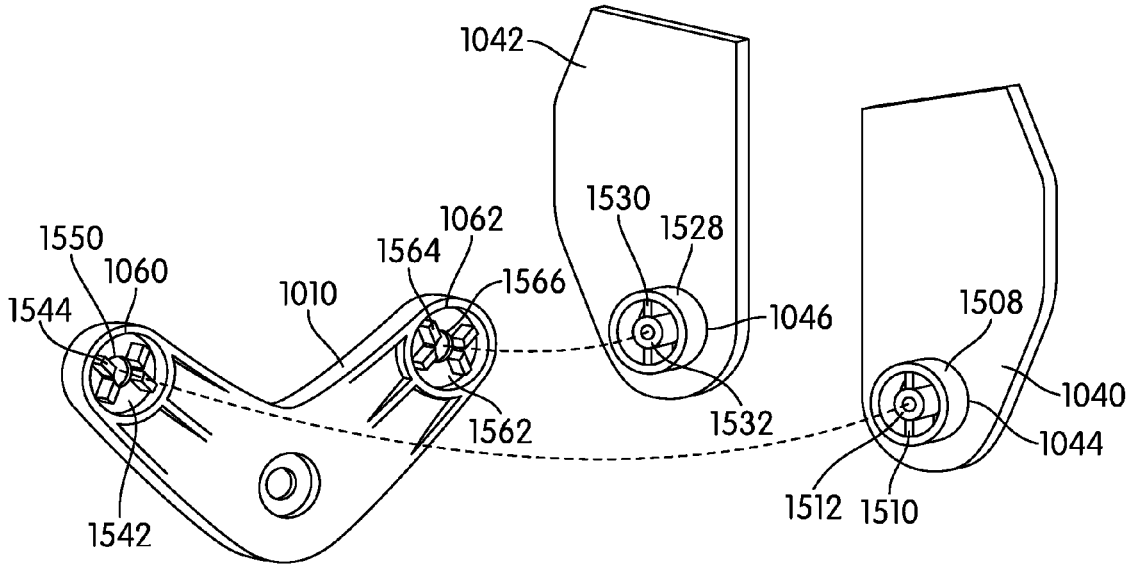
FIG. 15 is an isometric view of a preferred embodiment of an intermediate member and two plates.

FIG. 15 is a close up of a preferred embodiment of second plate 1040, third plate 1042 and intermediate member 1010 as they are configured to fasten to one another. In a manner similar to first large plate 1020, second plate 1040 includes second positive attachment region 1044. Second positive attachment region 1044 may include second rim 1508 and second raised portion 1510. In this embodiment, second raised portion 1510 is a thin raised rectangle that bisects second positive attachment region 1506. Second positive attachment region 1044 may also include third fastener hole 1512.

Preferably, intermediate member 1010 includes second negative attachment region 1060. Second negative attachment region 1060 preferably includes second recessed region 1542 and second set of raised stops 1544. In this embodiment, second set of raised stops 1544 form an X-like shape. Furthermore, second negative attachment region 1060 may also include fourth fastener hole 1550 that is configured to receive a fastener of some kind.

In this preferred embodiment, second recessed region 1542 is configured to receive second rim 1508, thereby mating second positive attachment region 1044 and second negative attachment region 1060. As regions 1044 and 1060 are joined, second raised portion 1510 is preferably inserted between second set of raised stops 1544. Finally, a fastener (not shown) may be inserted through third fastener hole 1512 and fourth fastener hole 1550 in order to permanently connect second plate 1040 and intermediate member 1010.

Preferably, third plate 1042 may be attached to intermediate member 1010 in a manner similar to the configuration of intermediate member 1010 and second plate 1040. In particular, third plate 1042 may include third positive attachment region 1046, including third rim 1528 and third raised portion 1530. Preferably, third positive attachment region 1046 also includes fifth fastener hole 1532. Third positive attachment region 1526 may be connected to intermediate member 1010 at third negative attachment region 1062. In particular, third recessed region 1562 may be configured to receive rim 1528. Furthermore, third raised portion 1530 may be inserted between third set of raised stops 1564. Finally, a fastener (not shown) may be inserted through fifth fastener hole 1532 and sixth fastener hole 1566 (associated with third recessed region 1562) to permanently attach third plate 1042 and intermediate member 1010.

Figure 16:
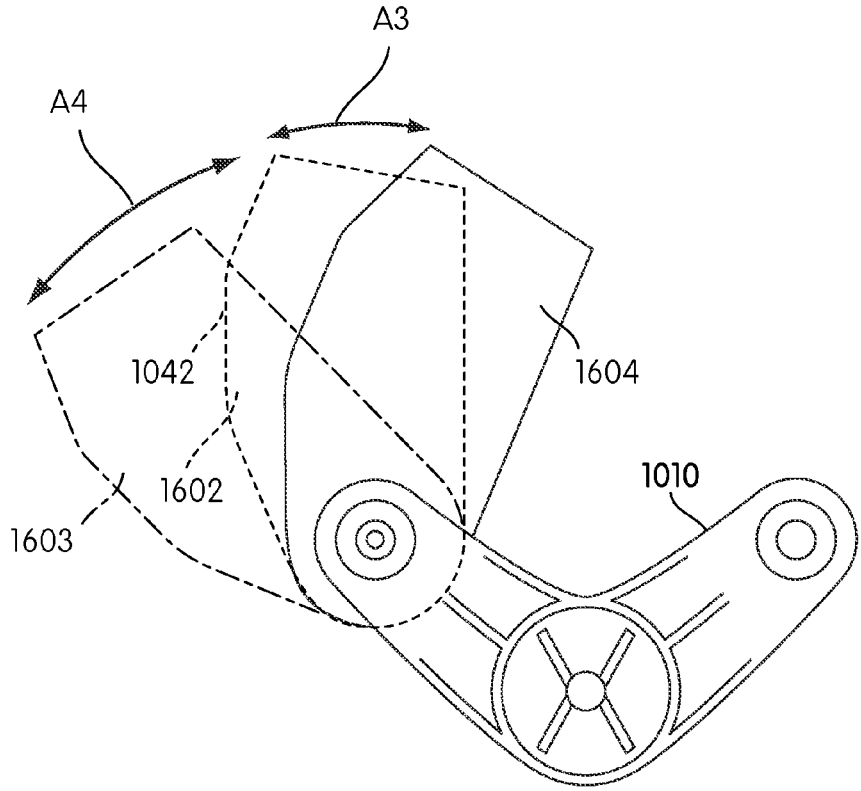
FIG. 16 is a preferred embodiment of a plate rotating with respect to an intermediate member.

FIG. 16 illustrates a preferred embodiment of the rotation of second plate 1042 with respect to intermediate member 1010. For clarity, only second plate 1042 is shown, however the following principles apply equally to the rotation of first plate 1040 with respect to intermediate member 1010. In this embodiment, second plate 1042 begins at first position 1602 and rotates clockwise to second position 1604. In this embodiment, second plate 1042 is prevented from rotating beyond second position 1604 because of third set of raised stops 1564 (see FIG. 15). Also, in this embodiment, second plate 1042 is rotated in a counterclockwise direction between first position 1602 and third position 1603. In this case, second plate 1042 is prevented from rotating beyond third position 1603 because of third set of rotating stops 1564. With this arrangement, the rotation of first plate 1040 and second plate 1042 may be limited by the use of raised stops in a similar manner to the configuration discussed for first large plate 1020.

Generally, the range of rotation of second plate 1042 in the clockwise direction or the counterclockwise direction may vary according to the arrangement of raised stops 1564. In this embodiment, second plate 1042 may be configured to rotate through an angle A3 in the clockwise direction, between first position 1602 and second position 1604. Likewise, in this embodiment, second plate 1042 may be configured to rotate through an angle A4 in the counterclockwise direction, between first position 1602 and third position 1603. In some cases, angles A3 and A4 may have similar values. In other cases, angles A3 and A4 could have different values. In a preferred embodiment, angle A3 has a value of approximately 22.5 degrees and angle A4 has a value of approximately 45 degrees. In other words, the range of motion of second plate 1042 from second position 1604 to third position 1603 is approximately 67.5 degrees.

Figure 17:
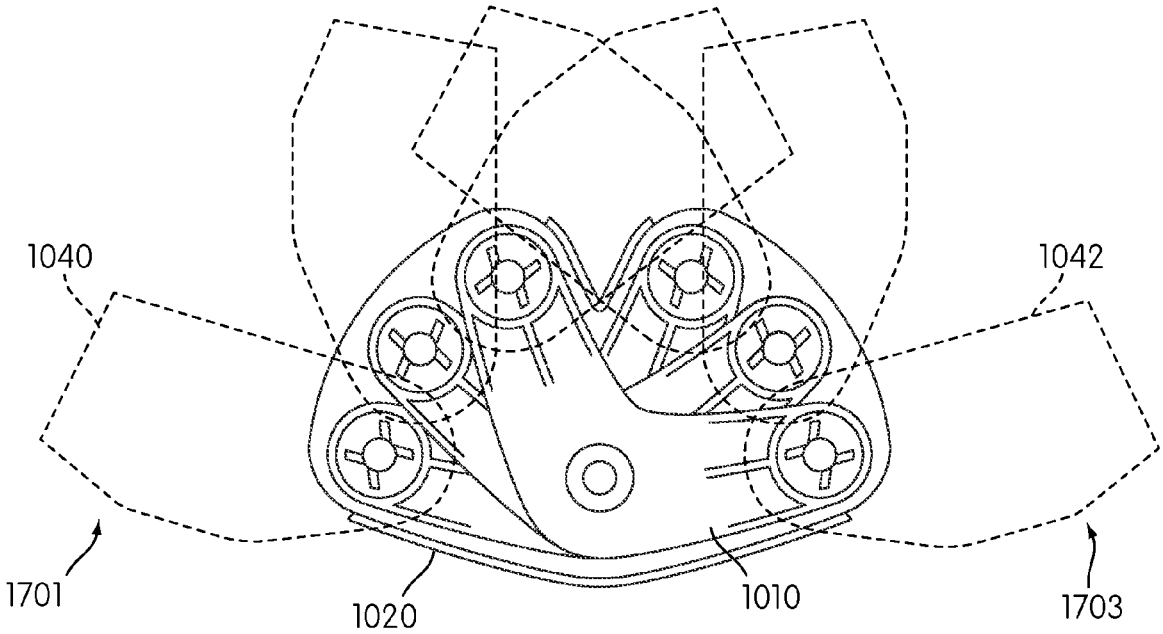
FIG. 17 is a preferred embodiment of the combined rotation of a plate and an intermediate member.
Figure 18:
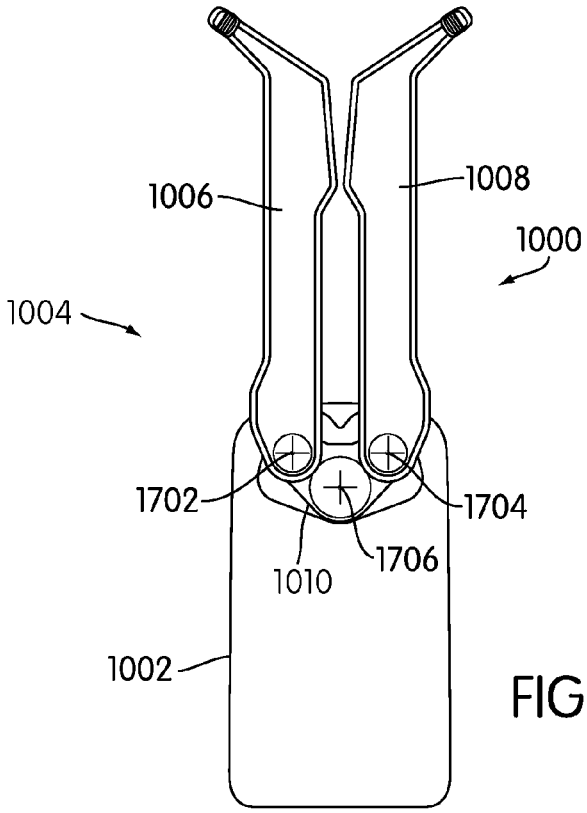
FIG. 18 is a schematic view of a preferred embodiment of a backpack.

FIG. 17 is a preferred embodiment of intermediate member 1010, first plate 1040, second plate 1042 and first large plate 1020 intended to schematically illustrate the range of motion of these components. Because plates 1040 and 1042 are further associated with straps 1006 and 1008 (see FIG. 10), FIG. 17 generally illustrates the range of motion of straps 1006 and 1008 with intermediate member 1010 as well. In this embodiment, intermediate member 1010 has been rotated through a variety of positions. Additionally, plates 1040 and 1042 have also been rotated through a variety of positions. For example, in a first position 1701, intermediate member 1010 and first plate 1040 are both maximally rotated in the counterclockwise direction. Likewise, in a second position 1703, intermediate plate 1010 and second plate 1042 are both maximally rotated in the clockwise direction. Using this preferred arrangement, a variety of positions for shoulder straps associated with first plate 1040 and second plate 1042 may be achieved through a combination of rotations of intermediate member 1010 with rotations of plates 1040 and 1042. It should be understood that this embodiment only illustrates a few of the possible positions for a strap system, and in other embodiments additional intermediate positions may be achieved through various other rotations of these components.

By rotating first intermediate member 1010 through a variety of positions, in combination with the rotation of first plate 1040 and second plate 1042, various positions for a strap system associated with a backpack may be achieved. The range of allowed positions may help increase stability. Furthermore, by restricting the degree of rotation of the individual components comprising the strap system, the strap system may be more easily maintained in an unworn state, as configurations allowing for full 360 degree rotations could result in tangled straps.

FIGS. 18-21 are intended to schematically illustrate the range of motion of shoulder strap system 1004. Beginning with FIG. 18, backpack 1000 starts in an initial position with straps 1006 and 1008 oriented vertically. First cross 1702 and second cross 1704 represent the orientation of first shoulder strap 1006 and second shoulder strap 1008 with respect to intermediate member 1010. Additionally, third cross 1706 represents the orientation of intermediate member 1010 with respect to bag 1002.

Figure 19:
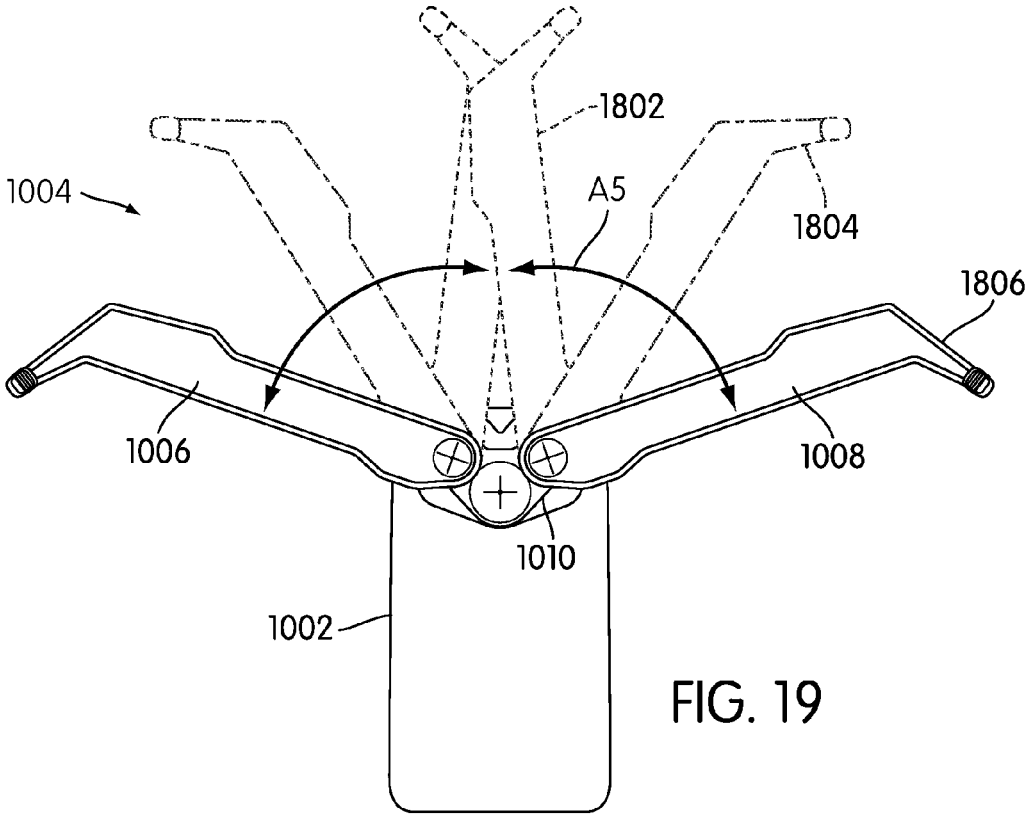
FIG. 19 is a schematic view of a preferred embodiment of a backpack with rotating shoulder straps.

Referring to FIG. 19, first shoulder strap 1006 and second shoulder strap 1008 may be rotated with respect to intermediate member 1010. In this embodiment, straps 1006 and 1008 are rotated from first position 1802, through second position 1804 to final position 1806. During first position

1802, first shoulder strap 1006 has rotated slightly clockwise, while second shoulder strap 1008 has rotated slightly counterclockwise. At second position 1804, first shoulder strap 1006 has rotated counterclockwise from first position 1802 and second shoulder strap 1008 has rotated clockwise from first position 1802. At final position 1806, first shoulder strap 1006 has fully rotated in the counterclockwise direction and second shoulder strap 1008 has fully rotated in the clockwise direction. In this final position 1806, first shoulder strap 1006 cannot rotate further in the counter clockwise position and second shoulder strap 1008 cannot rotate further in the clockwise position. In this embodiment, first shoulder strap 1006 and second shoulder strap 1008 have each rotated through an angle A5 between first position 1802 and final position 1806. In a preferred embodiment, the value of A5 is approximately 67.5 degrees, which is the full range of rotation of plates 1040 and 1042 (see FIGS. 15 and 16) with respect to intermediate member 1010.

Figure 20:
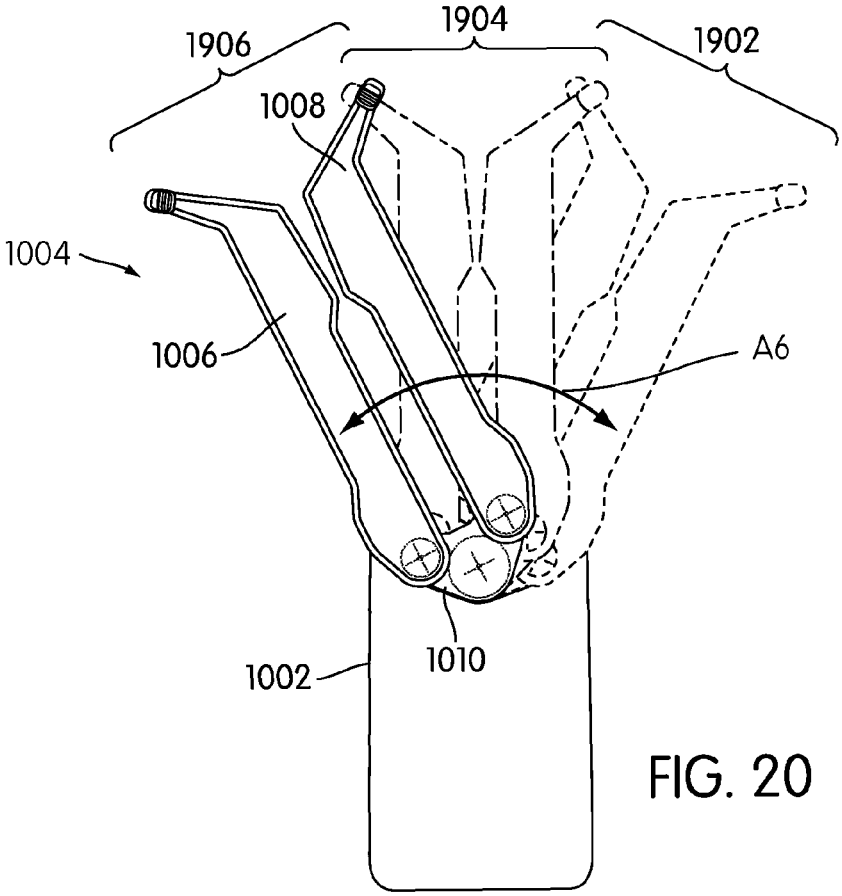
FIG. 20 is a schematic view of a preferred embodiment of a backpack with an intermediate member rotating.

Referring to FIG. 20, intermediate member 1010 may be rotated with respect to bag 1002. In this case, straps 1006 and 1008 are not rotated with respect to intermediate member 1010. Intermediate member 1010 is rotated from first position 1902, through second position 1904, to third position 1906. During first position 1902, intermediate member 1010 has been maximally rotated in the clockwise direction. During third position 1906, intermediate member 1010 has been maximally rotated in the counterclockwise direction. Second position 1904 corresponds to the initial position illustrated in FIG. 17. In this embodiment, straps 1006 and 1008 have been rotated through an angle A6 between first position 1902 and third position 1906 as intermediate member 1010 rotates. In a preferred embodiment, angle A6 has a value of approximately 58 degrees, which is the full range of rotation of intermediate member 1010 (see FIG. 13).

Figure 21:
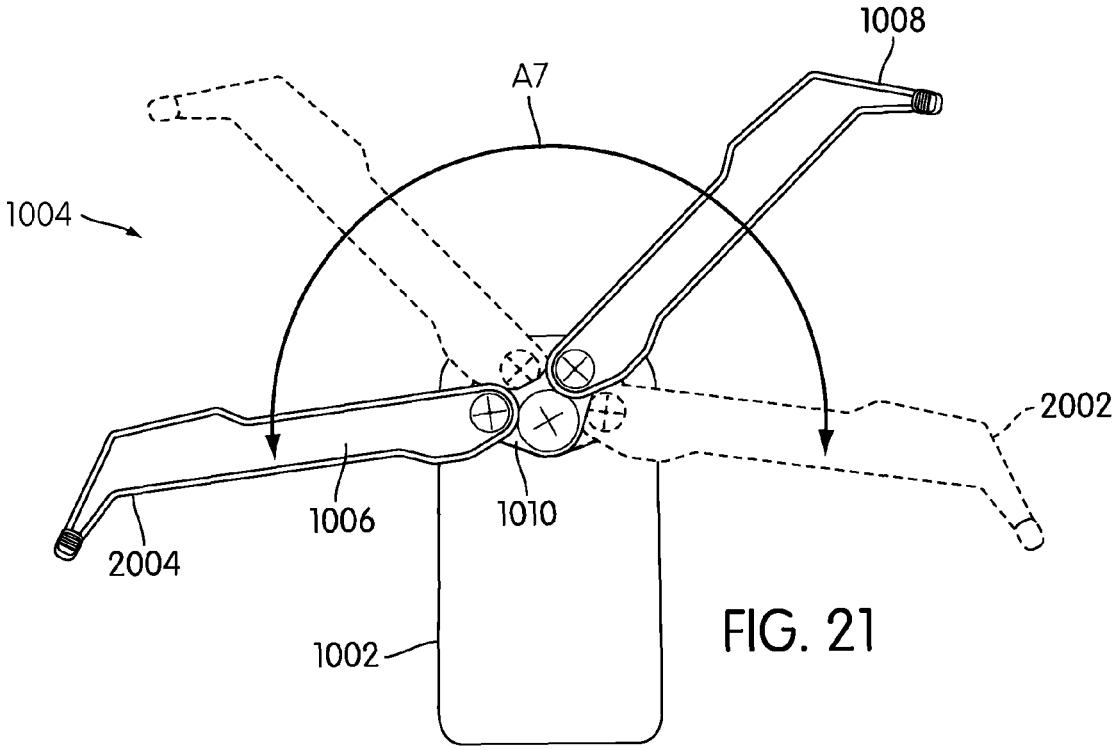
FIG. 21 is a schematic view of a preferred embodiment of a shoulder strap system undergoing rotation.

Referring to FIG. 21, the combination of rotation of straps 1006 and 1008 with the rotation of intermediate member 1010 provides for an increased range of motion. During a first position 2002, second shoulder strap 1008 and intermediate member 1010 are both maximally rotated in the clockwise direction. During a second position 2004, first shoulder strap 1006 and intermediate member 1010 are both maximally rotated in the counterclockwise direction. Additionally, any position between these two extreme positions 2002 and 2004 may be accomplished by various rotations of straps 1006, 1008 and intermediate member 1010. In this embodiment, strap system 1004 can be rotated through an angle A7 between second strap 1008 in a first position 2002 and first strap 1006 in a second position 2004. In a preferred embodiment, angle A7 is approximately 184 degrees.

Using the preferred arrangement described in these Figures, the range of motion of shoulder strap system 1004 may be limited. By maintaining fixed rotation ranges for straps 1006, 1008 and intermediate member 1010, strap system 1004 may facilitate increased balance for a user. Additionally, as previously mentioned, the restricted range of motion can help decrease the tendency of straps 1006 and 1008 to tangle when the backpack is not being worn. This arrangement may make it easier for a wearer to put on the backpack. Further, the restricted range of motion can prevent the backpack from flopping on the ground in order to facilitate lifting the backpack. For example, if the backpack were filled with heavy items, trying to lift the backpack by the straps from a rest position on the ground may cause the backpack to tend to rotate and not lift. Limiting the rotational movement may assist the wearer in exerting less force on the backpack to lift the backpack away from the ground. In another example, the wearer may wish to prop the backpack on the ground in an upright position, using the straps to prevent the backpack from falling over. Limiting the rotational movement of the backpack with respect to the straps may assist the user in achieving a stable positioning of the backpack on the ground.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A backpack, comprising:

a bag and a shoulder strap system;

the shoulder strap system including an intermediate member, a first shoulder strap, and a second shoulder strap;

the intermediate member being attached to the bag at a first connector;

the first shoulder strap being attached to the intermediate member at a second connector and the second shoulder strap being attached to the intermediate member at a third connector;

the first connector being disposed vertically below and horizontally between the second connector and the third connector of the intermediate member;

wherein the bag may pivot about the first connector, the first shoulder strap may pivot about the second connector, and the second shoulder strap may pivot about the third connector;

wherein the first connector stops pivoting of the bag at a first point in a clockwise direction and a second point in a counterclockwise direction to limit the pivoting of the bag to less than 360 degrees with respect to the intermediate member;

wherein the second connector stops pivoting of the first shoulder strap at a third point in a clockwise direction and a fourth point in a counterclockwise direction to limit pivoting of the first shoulder strap to less than 360 degrees with respect to the intermediate member;

wherein the third connector stops pivoting of the second shoulder strap at a fifth point in a clockwise direction and a sixth point in a counterclockwise direction to limit pivoting of the second shoulder strap to less than 360 degrees with respect to the intermediate member;

wherein the first connector comprises a positive attachment region and a negative attachment region;

wherein the positive attachment region and the negative attachment region are on separate components;

wherein the positive attachment region mates with the negative attachment region;

wherein the positive attachment region and the negative attachment region rotate with respect to each other;

wherein the positive attachment region comprises a raised portion;

wherein the negative attachment region defines a recessed region in which the raised portion rotates;

wherein the negative attachment region comprises a raised stop that limits rotation of the raised portion;

wherein the raised portion comprises a raised rectangle that bisects the positive attachment region, with a first portion of the raised rectangle on a first side of a rotational axis of the positive attachment region and a second portion of the raised rectangle on a second side of the rotational axis of the positive attachment region opposite to the first side, and wherein the raised stop comprises a set of raised stops formed in an X-like shape, with the first portion of the raised rectangle disposed between two of the raised stops and the second portion of the raised rectangle disposed between another two of the raised stops.

2. The backpack according to claim 1, wherein the first connector stops pivoting of the bag at the first point in the clockwise direction and the second point in the counterclockwise direction to limit the pivoting of the bag to approximately 58 degrees with respect to the intermediate member.

3. The backpack according to claim 1, wherein the second connector stops pivoting of the first shoulder strap at the third point in the clockwise direction and the fourth point in the counterclockwise direction to limit pivoting of the first shoulder strap to approximately 67.5 degrees with respect to the intermediate member; and wherein the third connector stops pivoting of the second shoulder strap at the fifth point in the clockwise direction and the sixth point in the counterclockwise direction to limit pivoting of the second shoulder strap to approximately 67.5 degrees with respect to the intermediate member.

4. The backpack according to claim 1, wherein the intermediate member has an asymmetric shape.

5. The backpack according to claim 1, wherein the intermediate member defines an outer perimeter having an overall v-shape, wherein the v-shaped outer perimeter has a first end portion, a middle vertex portion, and a second end portion, wherein the first end portion is positioned at an angle to the second end portion with respect to the middle vertex portion, to form the overall v-shape, and wherein the first connector is disposed at the middle vertex portion, the second connector is disposed at the first end portion, and the third connector is disposed at the second end portion.

6. The backpack according to claim 1, wherein the bag includes a plate having the positive attachment region;

wherein the backpack further comprises a cover attached to the bag;

wherein the cover includes a sleeve covering the plate and defines an opening;

wherein the plate is enclosed between the cover and the bag within the sleeve, with the positive attachment region aligned with the opening;

wherein the intermediate member is disposed on an exterior side of the cover opposite to an interior side on which the plate is disposed; and wherein the negative attachment region of the intermediate member is aligned with the opening.

7. The backpack according to claim 6, wherein the plate is attached to the bag solely by the sleeve of the cover.

8. A backpack, comprising:

a bag attached to a shoulder strap system;

the shoulder strap system including an intermediate member, a first shoulder strap, and a second shoulder strap;

the intermediate member being attached to the bag at a first connector;

the first shoulder strap being attached to the intermediate member at a second connector and the second shoulder strap being attached to the intermediate member at a third connector;

the first connector being disposed vertically below and horizontally between the second connector and the third connector of the intermediate member;

wherein the bag may pivot about the first connector, the first shoulder strap may pivot about the second connector, and the second shoulder strap may pivot about the third connector;

wherein the first connector stops pivoting of the bag at a first point in a clockwise direction and a second point in a counterclockwise direction to limit the pivoting of the bag to a pivot range of less than 360 degrees with respect to the intermediate member;

wherein the second connector stops pivoting of the first shoulder strap at a third point in a clockwise direction and a fourth point in a counterclockwise direction to limit pivoting of the first shoulder strap to less than 360 degrees with respect to the intermediate member;

wherein the third connector stops pivoting of the second shoulder strap at a fifth point in a clockwise direction and a sixth point in a counterclockwise direction to limit pivoting of the second shoulder strap to less than 360 degrees with respect to the intermediate member;

wherein the first connector comprises a positive attachment region and a negative attachment region;

wherein the positive attachment region and the negative attachment region are on separate components;

wherein the positive attachment region mates with the negative attachment region;

wherein the positive attachment region and the negative attachment region rotate with respect to each other;

wherein the positive attachment region comprises a raised portion;

wherein the negative attachment region defines a recessed region in which the raised portion rotates;

wherein the negative attachment region comprises a raised stop that limits rotation of the raised portion;

wherein the raised portion comprises a raised rectangle that bisects the positive attachment region, with a first portion of the raised rectangle on a first side of a rotational axis of the positive attachment region and a second portion of the raised rectangle on a second side of the rotational axis of the positive attachment region opposite to the first side;

wherein the raised stop comprises a set of raised stops formed in an X-like shape, with the first portion of the raised rectangle disposed between two of the raised stops and the second portion of the raised rectangle disposed between another two of the raised stops; and wherein a central axis that bisects that bag and intersects the bag's center of mass is oriented in a generally downwards direction at all positions within the pivot range.

9. The backpack according to claim 8, wherein the intermediate member defines an outer perimeter having an overall v-shape, wherein the v-shaped outer perimeter has a first end portion, a middle vertex portion, and a second end portion, wherein the first end portion is positioned at an angle to the second end portion with respect to the middle vertex portion, to form the overall v-shape, and wherein the first connector is disposed at the middle vertex portion, the second connector is disposed at the first end portion, and the third connector is disposed at the second end portion.

10. The backpack according to claim 8, wherein the positive attachment region includes a rim, and wherein the recessed region of the negative attachment region receives the rim.

11. The backpack according to claim 8, wherein the bag includes a plate having the positive attachment region;

wherein the plate defines an outer perimeter, wherein the intermediate member comprises a first end at which the second connector is disposed and a second end at which the third connector is disposed, wherein the first connector is disposed horizontally between the first end and the second end, and wherein the first end and the second end of the intermediate member are confined within the outer perimeter of the plate over a full range of rotation of the intermediate member with respect to the plate.

12. The backpack according to claim 8, wherein each of the second connector and the third connector comprises a shoulder strap positive attachment region and a shoulder strap negative attachment region;

wherein the shoulder strap positive attachment region and the shoulder strap negative attachment region are on separate components;

wherein the shoulder strap positive attachment region mates with the shoulder strap negative attachment region;

wherein the shoulder strap positive attachment region and the shoulder strap negative attachment region rotate with respect to each other;

wherein the shoulder strap positive attachment region comprises a shoulder strap raised portion;

wherein the shoulder strap negative attachment region defines a shoulder strap recessed region in which the shoulder strap raised portion rotates; and wherein the shoulder strap negative attachment region comprises a shoulder strap raised stop that limits rotation of the shoulder strap raised portion.

13. The backpack according to claim 8, wherein the bag includes a plate having the positive attachment region;

wherein the backpack further comprises a cover attached to the bag;

wherein the cover includes a sleeve covering the plate and defines an opening;

wherein the plate is enclosed between the cover and the bag within the sleeve, with the positive attachment region aligned with the opening;

wherein the intermediate member is disposed on an exterior side of the cover opposite to an interior side on which the plate is disposed; and wherein the negative attachment region of the intermediate member is aligned with the opening.

14. The backpack according to claim 13, wherein the plate is attached to the bag solely by the sleeve of the cover.

15. A backpack, comprising:

a bag and a shoulder strap system;

the shoulder strap system being attached to the bag by a connector;

wherein the backpack can pivot about the connector through a plane parallel with a front side of the backpack;

wherein the connector comprises a first connector;

wherein the shoulder strap system includes a first shoulder strap, a second shoulder strap, and an intermediate member;

wherein the first shoulder strap is attached to the intermediate member via a second connector and the first shoulder strap is configured to pivot around the second connector;

wherein the second shoulder strap is attached to the intermediate member via a third connector and the second shoulder strap is configured to pivot around the third connector;

wherein the bag includes a plate with a positive attachment region;

wherein the intermediate member includes a negative attachment region associated with the positive attachment region;

wherein the positive attachment region and the negative attachment region comprise the first connector;

wherein the intermediate member rotates with respect to the bag through the connection between the positive attachment region and the negative attachment region;

wherein the first connector stops pivoting of the bag at a first point in a clockwise direction and a second point in a counterclockwise direction to limit the pivoting of the bag to less than 360 degrees with respect to the intermediate member;

wherein the second connector stops pivoting of the first shoulder strap at a third point in a clockwise direction and a fourth point in a counterclockwise direction to limit pivoting of the first shoulder strap to less than 360 degrees with respect to the intermediate member;

wherein the third connector stops pivoting of the second shoulder strap at a fifth point in a clockwise direction and a sixth point in a counterclockwise direction to limit pivoting of the second shoulder strap to less than 360 degrees with respect to the intermediate member;

wherein the positive attachment region comprises a raised portion;

wherein the negative attachment region defines a recessed region in which the raised portion rotates; and wherein the negative attachment region comprises a raised stop that limits rotation of the raised portion;

wherein the raised portion comprises a raised rectangle that bisects the positive attachment region, with a first portion of the raised rectangle on a first side of a rotational axis of the positive attachment region and a second portion of the raised rectangle on a second side of the rotational axis of the positive attachment region opposite to the first side, and wherein the raised stop comprises a set of raised stops formed in an X-like shape, with the first portion of the raised rectangle disposed between two of the raised stops and the second portion of the raised rectangle disposed between another two of the raised stops.

16. The backpack according to claim 15, wherein the first connector stops pivoting of the bag at the first point in the clockwise direction and the second point in the counterclockwise direction to limit the pivoting of the bag to approximately 58 degrees with respect to the intermediate member.

17. The backpack according to claim 15, wherein the second connector stops pivoting of the first shoulder strap at the third point in the clockwise direction and the fourth point in the counterclockwise direction to limit pivoting of the first shoulder strap to approximately 67.5 degrees with respect to the intermediate member; and wherein the third connector stops pivoting of the second shoulder strap at the fifth point in the clockwise direction and the sixth point in the counterclockwise direction to limit pivoting of the second shoulder strap to approximately 67.5 degrees with respect to the intermediate member.

18. The backpack according to claim 15, wherein the intermediate member has an asymmetric shape.

19. The backpack according to claim 15, wherein the positive attachment region includes a rim, and wherein the recessed region of the negative attachment region receives the rim.

20. The backpack according to claim 15, wherein the intermediate member is pivotably fastened to the plate at the rotational axis of the positive attachment region.

21. The backpack according to claim 15, wherein the plate defines an outer perimeter, wherein the intermediate member comprises a first end at which the second connector is disposed and a second end at which the third connector is disposed, wherein the first connector is disposed horizontally between the first end and the second end, and wherein the first end and the second end of the intermediate member are confined within the outer perimeter of the plate over a full range of rotation of the intermediate member with respect to the plate.

22. The backpack according to claim 15, wherein the plate defines an outer perimeter having a first rounded side and a second rounded side;

wherein the intermediate member defines an outer perimeter; and wherein the first connector limits the pivoting of the bag such that the entire outer perimeter of the intermediate member remains within the outer perimeter of the plate during a full range of rotation of the intermediate member and the plate supports the intermediate member during the full range of rotation of the intermediate member.

23. The backpack according to claim 15, wherein the intermediate member defines an outer perimeter having an overall v-shape, wherein the v-shaped outer perimeter has a first end portion, a middle vertex portion, and a second end portion, wherein the first end portion is positioned at an angle to the second end portion with respect to the middle vertex portion, to form the overall v-shape, and wherein the first connector is disposed at the middle vertex portion, the second connector is disposed at the first end portion, and the third connector is disposed at the second end portion.

24. The backpack according to claim 23, wherein the plate defines an outer perimeter having a v-shaped bottom and rounded sides that correspond to a range of positions through which the v-shaped intermediate member may move.

25. The backpack according to claim 15, further comprising a cover attached to the bag;

wherein the cover includes a sleeve covering the plate and defines an opening;

wherein the plate is enclosed between the cover and the bag within the sleeve, with the positive attachment region aligned with the opening;

wherein the intermediate member is disposed on an exterior side of the cover opposite to an interior side on which the plate is disposed; and wherein the negative attachment region of the intermediate member is aligned with the opening.

26. The backpack according to claim 25, wherein the plate is attached to the bag solely by the sleeve of the cover.

27. The backpack according to claim 25, wherein the cover includes padding.

28. The backpack according to claim 15, wherein each of the second connector and the third connector comprises a shoulder strap positive attachment region and a shoulder strap negative attachment region;

wherein the shoulder strap positive attachment region and the shoulder strap negative attachment region are on separate components;

wherein the shoulder strap positive attachment region mates with the shoulder strap negative attachment region;

wherein the shoulder strap positive attachment region and the shoulder strap negative attachment region rotate with respect to each other;

wherein the shoulder strap positive attachment region comprises a shoulder strap raised portion;

wherein the shoulder strap negative attachment region defines a shoulder strap recessed region in which the shoulder strap raised portion rotates; and wherein the shoulder strap negative attachment region comprises a shoulder strap raised stop that limits rotation of the shoulder strap raised portion.

29. The backpack according to claim 28, wherein the shoulder strap raised portion comprises a shoulder strap raised rectangle that bisects the shoulder strap positive attachment region, with a first portion of the shoulder strap raised rectangle on a first side of a rotational axis of the shoulder strap positive attachment region and a second portion of the shoulder strap raised rectangle on a second side of the rotational axis of the shoulder strap positive attachment region opposite to the first side of the rotational axis of the shoulder strap positive attachment region, and wherein the shoulder strap raised stop comprises a set of shoulder strap raised stops formed in an X-like shape, with the first portion of the shoulder strap raised rectangle disposed between two of the shoulder strap raised stops and the second portion of the shoulder strap raised rectangle disposed between another two of the shoulder strap raised stops.

* * * * *